US009404382B2

(12) United States Patent
Kato

(10) Patent No.: US 9,404,382 B2
(45) Date of Patent: Aug. 2, 2016

(54) METHOD AND APPARATUS FOR SAFETY OPERATION OF EXTRACTION STEAM TURBINE UTILIZED FOR POWER GENERATION PLANT

(71) Applicant: FUJI ELECTRIC CO., LTD., Kawasaki-shi (JP)

(72) Inventor: Yoshifumi Kato, Tokyo (JP)

(73) Assignee: FUJI ELECTRIC CO., LTD., Kawasaki-Shi (JP)

( * ) Notice: Subject to any disclaimer, the term of this patent is extended or adjusted under 35 U.S.C. 154(b) by 0 days.

(21) Appl. No.: 14/478,648

(22) Filed: Sep. 5, 2014

(65) Prior Publication Data

US 2014/0373541 A1 Dec. 25, 2014

Related U.S. Application Data

(63) Continuation of application No. PCT/JP2013/081425, filed on Nov. 21, 2013.

(30) Foreign Application Priority Data

Apr. 5, 2013 (JP) ..... 2013-079430

(51) Int. Cl.
*F01D 17/08* (2006.01)
*F01D 17/10* (2006.01)
(Continued)

(52) U.S. Cl.
CPC ..... *F01D 17/08* (2013.01); *F01D 17/10* (2013.01); *F01D 17/145* (2013.01); *F01D 21/14* (2013.01);
(Continued)

(58) Field of Classification Search
CPC ..... F01D 17/08; F01D 17/10; F01K 13/02; F01K 7/17
See application file for complete search history.

(56) References Cited

U.S. PATENT DOCUMENTS 2,540,691 A * 2/1951 Reese ..... F01K 7/24 251/32
3,242,678 A * 3/1966 Kochey, Jr. ..... F01D 19/02 122/406.4
(Continued)

FOREIGN PATENT DOCUMENTS

JP S63-100203 A 5/1988
JP H07-119408 A 5/1995
(Continued)

OTHER PUBLICATIONS

PCT, "International Search Report for International Application No. PCT/JP2013/081425".
(Continued)

*Primary Examiner* — Thomas Denion
*Assistant Examiner* — Shafiq Mian
(74) *Attorney, Agent, or Firm* — Manabu Kanesaka

(57) ABSTRACT

A safety operation method includes detecting a steam pressure inside a high-pressure casing of the high-pressure part and a steam pressure inside a low-pressure casing of the low-pressure part; obtaining a low-pressure casing limit pressure as a reference corresponding to a pressure of the high-pressure casing in each detection, on a basis of a pressure correlation line expressing a prescribed special relation between preset high-pressure casing pressure and low-pressure casing pressure of the extraction steam turbine; comparing the low-pressure casing limit pressure with the detected pressure of the low-pressure casing; and forcibly throttling an opening of the main steam control valve to reduce the flow rate of steam flowing into the high-pressure part, in a state in which the extraction control valves continue controlling an operation of the extraction steam pressure, when the detected pressure of the low-pressure casing is judged to be higher than the low-pressure casing limit pressure.

6 Claims, 12 Drawing Sheets

(51) Int. Cl.

| | |
|---|---|
| ***F01K 7/18*** | (2006.01) |
| ***F01K 13/02*** | (2006.01) |
| ***F01D 17/14*** | (2006.01) |
| ***F01D 21/14*** | (2006.01) |
| ***F01K 7/04*** | (2006.01) |

(52) U.S. Cl.
CPC ... *F01K 7/04* (2013.01); *F01K 7/18* (2013.01); *F01K 13/02* (2013.01); *F05D 2220/31* (2013.01); *F05D 2270/301* (2013.01)

(56) References Cited

U.S. PATENT DOCUMENTS

| | | | | | |
|---|---|---|---|---|---|
| 3,322,153 | A * | 5/1967 | Rankin | F01D 1/023 | 137/630.19 |
| 4,320,625 | A * | 3/1982 | Westphal | F01D 19/02 | 60/646 |
| 4,793,132 | A * | 12/1988 | Okabe | F01D 19/00 | 122/7 R |
| 5,042,246 | A * | 8/1991 | Moore | F01D 19/00 | 60/39.182 |
| 5,201,180 | A * | 4/1993 | Girbig | F01D 1/023 | 60/646 |
| 5,361,585 | A * | 11/1994 | Westphal | F01K 7/24 | 60/646 |
| 5,490,386 | A * | 2/1996 | Keller | F01K 13/025 | 60/657 |
| 5,533,337 | A * | 7/1996 | Kusayama | F22D 11/02 | 60/646 |
| 6,915,635 | B2 * | 7/2005 | Wolf | F01D 17/08 | 60/646 |
| 7,028,479 | B2 * | 4/2006 | Gobrecht | F01D 25/10 | 60/646 |
| 7,392,656 | B2 | 7/2008 | Onuma et al. | | |
| 8,104,282 | B2 * | 1/2012 | Tani | F01K 7/345 | 60/645 |
| 8,505,299 | B2 * | 8/2013 | Mundra | F01D 17/18 | 415/116 |
| 8,656,718 | B2 * | 2/2014 | Takeshita | F01D 17/08 | 60/646 |
| 8,720,203 | B2 * | 5/2014 | Sasanuma | B01D 53/1425 | 423/220 |
| 2002/0081191 | A1 * | 6/2002 | Tremmel | F01D 1/023 | 415/1 |
| 2010/0043438 | A1 * | 2/2010 | Barber | F01D 21/00 | 60/646 |
| 2010/0170246 | A1 * | 7/2010 | Chaki | G21C 1/084 | 60/644.1 |
| 2011/0056201 | A1 * | 3/2011 | Kluge | F01K 3/181 | 60/653 |
| 2011/0185732 | A1 * | 8/2011 | Eppendorfer | F01D 1/023 | 60/645 |
| 2011/0185744 | A1 * | 8/2011 | Tong | F01K 13/02 | 60/778 |
| 2011/0318169 | A1 * | 12/2011 | Zheng | F01D 11/025 | 415/169.1 |
| 2012/0011852 | A1 * | 1/2012 | Mundra | F01D 17/18 | 60/660 |
| 2012/0240579 | A1 * | 9/2012 | Hirata | B01D 53/1425 | 60/653 |
| 2013/0312416 | A1 * | 11/2013 | Herzog | F01K 7/223 | 60/653 |

FOREIGN PATENT DOCUMENTS

| | | | |
|---|---|---|---|
| JP | H07-243304 | A | 9/1995 |
| JP | H08-105303 | A | 4/1996 |
| JP | H10-141013 | A | 5/1998 |
| JP | 3186468 | B2 | 7/2001 |
| JP | 2001-317305 | A | 11/2001 |

OTHER PUBLICATIONS

German Patent Office, "Office Action for DE 112013001671.0," Apr. 16, 2015.

Japan Patent Office, "Office Action for JP 2013-079430," Jul. 2, 2013.

* cited by examiner

METHOD AND APPARATUS FOR SAFETY OPERATION OF EXTRACTION STEAM TURBINE UTILIZED FOR POWER GENERATION PLANT

RELATED APPLICATIONS

The present application is National Phase of International Application No. PCT/JP2013/081425 filed Nov. 21, 2013, and claims priority from Japanese Application No. 2013-079430 filed Apr. 5, 2013.

TECHNICAL FIELD

The present invention relates to a method and apparatus for safety operation for the purpose of preventing damage to a thrust bearing caused by excessive thrusting force acting on an extraction steam turbine utilized for power generation plant that supplies steam to a production process.

BACKGROUND ART

Conventionally, an extraction steam turbine utilized for power generation plant having an extraction pipe for extracting some of steam from the steam turbine driving a generator and supplying the extracted steam to a production process using the steam has been generally known, for example, as described in Patent Document 1. The configuration of this steam turbine power generation plant described in Patent Document 1 is shown in FIG. 12.

In FIG. 12, reference numeral 1 represents a boiler, reference numeral 2 represents an extraction steam turbine provided with a high-pressure portion 3 and a low-pressure portion 4 each of which has blade rows, reference numeral 5 represents a condenser for condensing steam discharged from the extraction steam turbine 2, reference numeral 6 represents a generator directly coupled to and driven by the turbine 2, and reference numeral 7 represents a deaerator for heating and deaerating condensate water obtained from the condenser 5. Note that the extraction steam turbine 2 is also provided with a main steam control valve 8 for controlling the flow rate of main steam flowing into the high-pressure part 3, and extraction control valves 9 for controlling the flow rate of steam flowing from the high-pressure part 3 into the low-pressure part 4 to control the pressure of extraction steam.

A feedwater supply system 10 connected to the condenser 5 and the boiler 1 has a condensate pump 11, a first low-pressure feedwater heater 12, a second low-pressure feedwater heater 13, the deaerator 7, a feedwater pump 14, and a high-pressure feedwater heater 15. An extraction pipe 19 for supplying a process 16 with extraction steam, which is controlled to have a predetermined pressure by the extraction control valves 9, is connected to an outlet of the high-pressure part 3 of the extraction steam turbine 2. Note that reference numeral 20 represents a main steam pipe that is connected to the boiler 1 and the main steam regulating valve 8.

An extraction pipe for high-pressure feedwater heater 21 branches off from the extraction pipe 19 in order to be connected to the high-pressure feedwater heater 15, and has a check valve 22 and a stop valve 23. Note that reference numeral 24 represents a drain pipe that leads drain of the high-pressure feedwater heater 15 to the deaerator 7. An extraction pipe for deaerator 25 is connected to the low-pressure part 4 of the extraction steam turbine 2 and to the deaerator 7, and has a check valve 26 and a stop valve 27.

An extraction pipe for second low-pressure feedwater heater 29 is connected to the low-pressure portion 4 of the extraction steam turbine 2 and to the second low-pressure feedwater heater 13, and has a check valve 30 and a stop valve 31. An extraction pipe for first low-pressure feedwater heater 33 is connected to the low-pressure portion 4 of the extraction steam turbine 2 and to the first low-pressure feedwater heater 12, and has a check valve 34 and a stop valve 35. Note that reference numeral 36 represents a drain pipe that leads a drain of the second low-pressure feedwater heater 13 to the first low-pressure feedwater heater 12.

In such a configuration, main steam supplied from the boiler 1 has its flow rate controlled by the main steam control valve 8, enters the extraction steam turbine 2 to flow through high-pressure blade rows of the high-pressure part 3 and low-pressure blade rows of the low-pressure part 4, and thereby rotates a turbine rotor to perform a task. Also, steam discharged from the low-pressure part 4 flows into the condenser 5 that is kept at a pressure lower than atmospheric pressure, and is then formed into condensed water. It should be noted that thrust force that acts on the turbine rotor due to the steam flowing through the casings of the high-pressure part 3 and the low-pressure part 4 is supported by a thrust bearing. Extraction steam that is obtained from steam discharged from the outlet of the high-pressure part 3 is controlled to have a predetermined pressure by the extraction control valves 9 and then supplied to the process 16 via the extraction pipe 19.

In the configuration shown in FIG. 12, some of the extraction steam is supplied to the high-pressure feedwater heater 15 via the extraction pipe for high-pressure feedwater heater 21 that branches off from the extraction pipe 19.

The rest of the steam that is extracted from the extraction pipe 19 of the high-pressure part 3 is discharged and supplied to the low-pressure part 4 through the extraction control valves 9.

The generator 6 generates electric power that corresponds to the work of the task that the steam performs by flowing through the high-pressure portion 3 and the low-pressure portion of the extraction steam turbine 2 and rotating the turbine rotor.

The condensate water in the condenser 5 is pressurized by the condensate water pump 11 of a feedwater supply system 10 and fed to the first and second low-pressure feedwater heaters 12 and 13. In these feedwater heaters 12, 13, the condensate water is heated by uncontrolled extraction steam that flows from the low-pressure part 4 through the extraction pipes for first and second low-pressure feedwater heaters 33, 29. The heated condensate water flows into the deaerator 7 and is then heated and deaerated by uncontrolled extraction steam that is supplied from the low-pressure part 4 through the extraction pipe for deaerator 25.

The condensate water that is deaerated by the deaerator 7, which is the feed water, has its pressure increased by the feedwater pump 14, flows into the high-pressure feedwater heater 15, is then heated at this high-pressure feedwater heater 15 by uncontrolled extraction steam that flows from the high-pressure part 3 through the extraction pipe for high-pressure feedwater heater 21, and then supplied to the boiler 1. The feedwater supplied to the boiler 1 is heated into steam and then supplied to the extraction steam turbine 2 as the main steam.

In this type of general extraction steam turbine power generation plant, the steam coming from the boiler flows through the extraction steam turbine 2, and thereby rotates the turbine rotor to perform a task. Thereafter, the steam becomes condensate water at the steam condenser, which is supplied to the boiler 1 as feedwater and circulates among the boiler 1, the extraction steam turbine 2, and the condenser 5. In this circulation, the steam extracted from the extraction steam turbine 2 has its pressure controlled to be predetermined pressure by the extraction control valves 9 and is then supplied to the process 16 and to the feedwater heaters 12, 13, 15 and the deaerator 7 in an uncontrolled manner via the extraction pipes 33, 29, 21, 25, which have check valves and stop valves or only stop valves, thereby heating the feedwater.

As the extraction steam turbines which supply extraction steam to the process 16 are designed to be operated at their most efficient operating design point for usual operating conditions in which the steam turbines are kept operated for the most of their service life, so, for example, if a ratio of extraction steam flow to main steam flow at the design point should be very large and also the ratio at current operating point should be going to be smaller than that at the design point due to drastic decrease in demand for extraction steam, then the extraction control valves will be opened wider, resulting in drastic increase in the flow rate of steam flowing in the low-pressure casing 4 through blade rows of the extraction steam turbines in comparison with that at the nominal, usual operating point. As a result of this increase in the steam flow rate, the force received by the blades of the blade rows in the low-pressure part 4 increases, hence the stress added to the blades and thrust force acting on the turbine rotor. Thus, even when the stress acting on the blade stages is equal to or lower than a permissible value, excessive thrust force acts on the turbine rotor, resulting in possible damage to the thrust bearing.

In the extraction steam turbine 2 in which the extraction control valves 9 control the flow rate of the extraction steam, the steam, which flows through the blade rows of the low-pressure part 4 downstream of the extraction control valves 9, does not flow in an amount that cannot be tolerated by the fully open extraction control valves 9. However, in the system in which the uncontrolled extraction steam is supplied from the low-pressure part 4 to the plurality of feedwater heaters and the like, when, for example, the extraction pipe for deaerator 25 and the check valves 26 and 30 of the extraction pipe for second low-pressure feedwater heater 29 shown in FIG. 12 are damaged due to chatter caused by decrease in steam flow rate or vibration caused by excessively high steam flow velocity, and consequently the supply of the extraction steam to the feedwater heaters is stopped, the flow rate of the steam flowing to the low-pressure part 4 becomes greater than a defined amount. This involves a risk of excessive thrust force acting on the blade rows of the low-pressure part 4 or damage to the thrust bearing, as described above.

Patent Document 1 discloses a safety operation apparatus for extracting some of the steam discharged from the high-pressure part 3 with blade rows, supplying the extracted steam to the process and the like, and preventing damage to the thrust bearing from excessive thrust force that is caused by an increase in the flow rate of the rest of the steam flowing through the low-pressure part 4 with blade stages.

The safety operation apparatus disclosed in Patent Document 1 is shown in FIG. 13.

In the extraction steam turbine 2 that has the high-pressure part 3 and the low-pressure part 4, each of which has blade rows, the main steam control valve 8 controls the flow rate of steam flowing into the high-pressure part 3, and the extraction control valves 9 control the flow rate of steam flowing from the high-pressure part 3 into the low-pressure part 4, thereby controlling the pressure of steam that is extracted from the discharged steam of the high-pressure part 3 and supplied to the process 16. The extraction steam turbine 2 has an arithmetic control device 42 that provides opening commands OP8 and OP9 to a main steam control valve controller 44 for controlling the main steam control valve 8 and an extraction control valve controller 46 for controlling the extraction control valve 9, in response to detection signals from a high-pressure casing pressure detector 40 that detects the pressure of the steam of the high-pressure casing of the high-pressure part 3, and a low-pressure casing pressure detector 41 that detects the pressure of the steam of the low-pressure casing of the low-pressure part 4.

The arithmetic control device 42 functions to adjust and compute the pressure of the extraction steam. The arithmetic control device 42 compares steam pressure ("extraction pressure," hereinafter) Pp of the extraction pipe 19, which is detected by a extraction pressure detector 48 installed in the extraction pipe 19 coupled to the process 16, with set pressure Pps set by an extraction pressure setter 49, and creates the valve opening signal OP9 so that the extraction pressure Pp is equal to the set pressure Pps. A valve operation signal based on this valve opening signal OP9 is output from the extraction control valve controller 46, and converted into hydraulic signal by an electric-hydraulic converter 47, which is then provided to the extraction control valves 9. In this manner, the pressure of the extraction pipe 19 connected to the extraction steam turbine 2 and the process 16 to each other is controlled constantly to the set pressure by the arithmetic control device 42 and the extraction control valve controller 46. As a result, the pressure in the process 16 is kept at constant value.

During load (generating) operation of the extraction steam turbine 2, the arithmetic control device 42 compares low-pressure casing detection pressure Lp with low-pressure casing reference pressure Lpp that is delivered unambiguously by the high-pressure casing pressure Hp as a value on a correlation line P expressed as a linear equation formed by a special relation between the high-pressure casing pressure Hp and the low-pressure casing pressure Lp of the extraction steam turbine 2 as shown in FIG. 2. The special relation is a relationship between the Hp and the Lp, in which the thrust force generated in the extraction steam turbine 2 becomes a certain constant value depending on the combination of the flow rate of steam passing through the high-pressure part 3 and the flow rate of steam passing through the low-pressure part 4.

In other words, the correlation line P shown in FIG. 2 expresses a relationship between the flow rate of steam passing through the high-pressure part 3 and the flow rate of steam passing through the low-pressure part 4 when the value of the thrust force is a certain constant value during extraction pressure control operation of the extraction steam turbine 2. When the low-pressure casing pressure Lp is higher than the low-pressure casing reference pressure Lpp delivered in relation to the high-pressure casing pressure, and falls within the range of oblique lines above the correlation line P in FIG. 2, the arithmetic control device 42 sends an automatic control cancellation command CS to the extraction control valve controller 46 to cancel the extraction pressure control, and outputs the valve opening command OP8 to the main steam control valve 8 to reduce the valve opening thereof so that the low-pressure casing detection pressure Lp becomes lower than the low-pressure casing reference pressure Lpp delivered in relation g to the high-pressure casing pressure according to the correlation pressure relationship and that the load of the extraction steam turbine 2 becomes lower than the current load.

Note that the correlation line P in this case can express a relation between the low-pressure casing pressure and the high-pressure casing pressure that are obtained when the thrust force is equal to a value equivalent to a tolerance surface pressure of the thrust bearing.

According to such a safety operation apparatus, when the casing pressure Lp of the low-pressure portion 4 in the extraction steam turbine 2 falls within the range of oblique lines above the correlation line P of FIG. 2, the arithmetic control device 42 controls the main steam control valve 8 and the extraction control valves 9 to reduce the casing pressure Lp of the low-pressure portion 4 to a pressure below the correlation line P of FIG. 2 and operate the turbine. The safety operation apparatus, therefore, can prevent damage to the thrust bearing of the extraction steam turbine without causing excessive thrusting force to act on the thrust bearing.

Patent Document 1: Japanese Patent No. 3186468

DISCLOSURE OF THE INVENTION

As described above, the conventional safety operation apparatus for an extraction steam turbine power generation plant is configured to cancel the extraction pressure control by the extraction control valves when the low-pressure casing pressure Lp of the extraction steam turbine 2 becomes higher than a reference low-pressure casing pressure which is defined unambiguously as the low-pressure casing pressure on the pressure correlation line P that corresponds to the high-pressure casing pressure, based on the pressure correlation line P of FIG. 2 expressing the special relation between the high-pressure casing pressure and the low-pressure casing pressure.

However, in the extraction steam turbine utilized for power generation plant with an extraction supply system for supplying the process with part of steam extracted from the extraction steam turbine, canceling the extraction pressure control reduces the pressure of the extraction steam supplied from the extraction steam turbine to the process, resulting in discontinuation of the supply of the steam to the process. Discontinuation of the supply of the extraction steam causes discontinuation of the production of products, generating a significant operation loss in the production process requiring steam.

In addition, during the load operation, i.e., power generating operation (hereinafter, the term "load" means "power output" in the present invention unless otherwise specified), the load is reduced below the current load, but the conventional safety apparatus disclosed in Patent Document 1 does not mention the limitations of change of load.

Generally, when a local electric power network system is supplied with surplus power that is obtained by subtracting the power to be used in a factory from the power generated by the extraction steam turbine power generation plant, significant decrease of the load not only has a great impact on the production process that uses the power, but also drastically changes the amount of power supplied, ending up with having a critical impact on the local electric power network system.

In the technology disclosed in Patent Document 1, therefore, significant decrease of the load develops problems in the operation of the power generation plant.

In the extraction steam turbine power generation plant designed to supply power and steam to the production plant as described above, suddenly discontinuing the extraction pressure control or endlessly reducing the power output out of a production plant operation plan, is likely to bring about a negative impact on the operations of the electric power network system and the production process that uses steam.

In order to solve these problems, an object of the present invention is to provide a method and apparatus for safety operation of extraction steam turbine power generation plants, which are capable of preventing damage to a thrust bearing of an extraction steam turbine without having much impact on the operations of electric power network system and production process that uses steam.

In order to achieve this object, a safety operation method according to the present invention is a safety operation method for extraction steam turbine power generation plants that have an extraction steam turbine configured by a high-pressure part and a low-pressure part each having blade rows. The extraction steam turbine power generation plant is configured to drive a generator with the extraction steam turbines, control a flow rate of steam flowing into the high-pressure part of the extraction steam turbine with a main steam control valve, and adjust a flow rate of steam discharged from the high-pressure part and supplied to the low-pressure part with extraction control valves, to thereby extract a part of the steam discharged from the high-pressure part and control a pressure of extraction steam supplied to process.

The safety operation method includes: detecting a steam pressure inside a high-pressure part of the high-pressure portion and a steam pressure inside a low-pressure casing of the low-pressure part; obtaining a low-pressure casing limit pressure as a reference corresponding to a pressure of the high-pressure casing in each detection, on a basis of a pressure correlation line expressing a special relation between a preset high-pressure casing pressure and low-pressure casing pressure of the extraction steam turbine; comparing the low-pressure casing limit pressure with the detected pressure of the low-pressure casing; and forcibly throttling an opening of the main steam control valve to reduce the flow rate of main steam flowing into the high-pressure part, in a state in which the extraction control valves continue controlling extraction steam pressure, when the detected pressure of the low-pressure casing is detected to be higher than the low-pressure casing limit pressure.

According to this method, an operation for throttling the opening of the main steam control valve when the low-pressure casing pressure is higher than the low-pressure casing limit pressure can be stopped when the flow rate of steam flowing into the high-pressure part is reduced and the current pressure of the low-pressure casing to low-pressure casing sheltering pressure or lower, which is a reference pressure set to be lower than the low-pressure casing limit pressure, and a load operation by the main steam control valve can be restarted under a load corresponding to the throttled valve opening of the main steam control valve.

Also, according to this method, during start-up of the extraction steam turbine power generation plant, setting is implemented at, in place of the low-pressure casing limit pressure, an initial low-pressure casing limit pressure until the flow rate of main steam supplied to the extraction steam turbine reaches flow rate enabling steady controlled extraction operation, the initial low-pressure casing limit pressure being reference pressure obtained based on an initial pressure correlation line that is different from a pressure correlation line for obtaining the low-pressure casing limit pressure and is set for a purpose of switching the operation mode to an extraction pressure control operation.

A safety operation apparatus according to the present invention is a safety operation apparatus for extraction steam turbine power generation plant that has an extraction steam turbine configured by a high-pressure part and a low-pressure part each having blade rows. The extraction steam turbine power generation plant is configured to drive a generator with the extraction steam turbine, control a flow rate of steam flowing into the high-pressure part of the extraction steam turbine with a main steam control valve, adjust a flow rate of steam discharged from the high-pressure part to supply to the low-pressure part with extraction control valves, and thereby extract part of the steam discharged from the high-pressure part and control, to a constant value, pressure of extraction steam supplied to process. The safety operation apparatus includes: pressure detection means for detecting steam pressure inside a high-pressure casing of the high-pressure part and steam pressure inside a low-pressure casing of the low-pressure part; means for obtaining a low-pressure casing limit pressure as a reference low-pressure casing pressure corresponding to pressure of the high-pressure casing in each detection, on a basis of a pressure correlation line expressing special relation between preset high-pressure casing pressure and low-pressure casing pressure of the extraction steam turbine; means for comparing the detected pressure of the low-pressure casing with the low-pressure casing limit pressure; and control means for throttling an opening of the main steam control valve to reduce the flow rate of steam flowing into the high-pressure part, in a state continuing an operation of a pressure control function of the extraction control valve, when the detected pressure of the low-pressure casing is higher than the low-pressure casing limit pressure.

According to this safety operation apparatus, a valve control command for throttling the opening of the main steam control valve when the detected pressure of the low-pressure casing is higher than the low-pressure casing limit pressure can stop the throttle operation when the low-pressure casing pressure becomes equal to or lower than a low-pressure casing sheltering pressure that is set to be lower than the low-pressure casing limit pressure by a predetermined value, and a load operation by the main steam control valve can be restarted under a load corresponding to the throttled valve opening of the main steam control valve.

In addition, means is provided for implementing setting at, upon starting-up of the extraction steam turbine utilized for power generation plant, in place of the low-pressure casing limit pressure, an initial low-pressure casing limit pressure until a flow rate of main steam supplied to the extraction steam turbine reaches a flow rate that is preset as a main steam flow rate so as to enable continuation of steady extraction pressure control operation, the initial low-pressure casing limit pressure being a reference pressure obtained based on an initial pressure correlation line different from the pressure correlation line for obtaining the low-pressure casing limit pressure and set for switching to an extraction pressure control operation.

The present invention can obtain the low-pressure casing limit pressure in relation to each detected pressure of the high-pressure casing, based on a pressure correlation line showing prescribed correlation between high-pressure casing pressure and low-pressure casing pressure. When, for some reason, the low-pressure casing pressure of the low-pressure part in the extraction steam turbine exceeds the low-pressure casing limit pressure, and consequently an excessive thrust force acts on a turbine rotor, the present invention can forcibly throttle the opening of the main steam control valve to reduce the flow rate of steam flowing into the high-pressure part, while continuing to control the pressure of the extraction steam. In this manner, the pressure of the low-pressure casing can be reduced while continuing to supply the extraction steam to the process, resulting in reduction of the thrust force acting on the turbine rotor.

When the low-pressure casing pressure of the low-pressure casing is reduced to the low-pressure casing sheltering pressure or lower as a result of decrease in the flow rate of steam flowing into the high-pressure part, the load operation by the main steam control valve is restarted under the load equivalent to the throttled valve opening of the main steam control valve. Therefore, change in the load is small. Meanwhile, the extraction control valves are automatically controlled to keep the pressure of the extraction steam at a predetermined level, which rarely has an impact on the process.

Such configurations of the present invention can minimize the impact of electric power network system receiving electric power from the extraction steam turbine power generation plant and the impact of production process receiving steam from the extraction steam turbine power generation plant, on the operation of the turbine. The present invention can therefore achieve safe and stable operation of the extraction steam turbine.

BEST MODE FOR CARRYING OUT THE INVENTION

Embodiments of the present invention are now described using the examples shown in the diagrams.

First Embodiment

Figure 1:
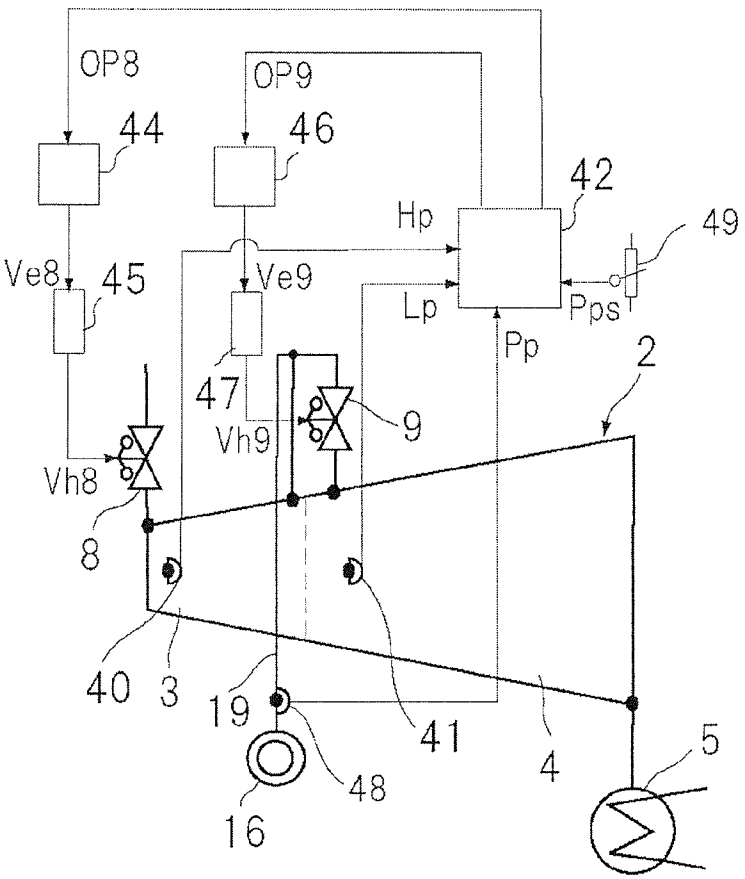
FIG. 1 is a system diagram of an extraction steam turbine plant that has a safety operation apparatus according to an embodiment of the present invention.

FIG. 1 shows a configuration of a safety operation apparatus according to a first embodiment of the present invention.

In FIG. 1, reference numeral 2 represents an extraction steam turbine (abbreviated hereinafter as "extraction turbine") configured by a high-pressure part 3 and a low-pressure part 4. The flow volume of main steam supplied from a boiler, not shown, to the high-pressure part 3 is controlled by a main steam control valve 8. While some of the steam discharged from the high-pressure part 3 is supplied to process 16 via an extraction pipe 19, the rest of the discharged steam is supplied to the low-pressure part 4 via an extraction control valves 9. The steam discharged from the low-pressure part 4 is condensed by a condenser 5, which is then returned to the boiler. The extraction turbine 2 supplies extraction steam from the extraction pipe 19 to the process 16 and drives a generator, not shown, which is coupled with the extraction turbine 2, to generate power.

The extraction turbine 2 is also provided with a high-pressure casing pressure detector 40 and a low-pressure casing pressure detector 41 that detect steam pressures inside casings of the high-pressure part 3 and the low-pressure part 4 of the extraction turbine 2 respectively. The pressure of the extraction steam supplied to the process 16 is detected by an extraction pressure detector 48 that is installed in the extraction pipe 19. Pressure detection signals from these pressure detectors 40, 41 and 48 are input to an arithmetic control device 42 that is configured by, for example, a programmable logic controller (referred to as "PLC," hereinafter). A PLC is an arithmetic control device in which a control function thereof can be configured or changed simply by replacing/modifying the software instead of replacing the hardware.

The PLC 42 compares a set pressure Pps of the extraction steam supplied to the process 16, which is input and set beforehand by an extraction pressure setter 49, with a detected pressure Pp of the extraction steam that is detected by the detector 48, creates an opening signal OP9 for changing the opening of the extraction control valves 9 so that the detected pressure Pp becomes equal to the set pressure Pps, and sends the opening signal OP9 to an extraction control valve controller 46. The extraction control valve controller 46 converts this valve opening signal OP9 into a valve operation signal Ve9 and sends the valve operation signal Ve9 to an electric-hydraulic converter 47, in which the valve operation signal Ve9 is converted into a hydraulic operation signal Vh9. The hydraulic operation signal Vh9 is then sent to the extraction control valves 9. As a result, the pressure of the extraction steam is kept constant at a set pressure.

Based on a load command, the PLC 42 further creates an opening signal OP8 to instruct opening of the main steam control valve 8, and sends the opening signal OP8 to a main steam control valve controller 44. The main steam control valve controller 44 converts the opening signal OP8 into valve operation signal Ve8, which is then converted into hydraulic operation signal Vh8 by an electric-hydraulic converter 45. The hydraulic operation signal Vh8 is then sent to the main steam control valve 8. In this manner, the opening of the main steam control valve 8 is controlled to the opening ordered by the PLC 42, thereby adjusting the flow rate of the main steam supplied to the high-pressure part 3.

Note that the opening signal OP8 of the main steam control valve 8 and the opening signal OP9 of the extraction control valves 9 are simultaneously controlled in constant relationship so that the amount of extraction steam is kept at a preset steam flow rate even when the flow rate of the main steam is changed. The relationship between the opening signal OP8 of the main steam control valve and the opening signal OP9 of the extraction control valves 9 is described hereinafter.

First of all, thrust force that is generated on each of blade rows of the extraction turbine 2 is described with reference to FIG. 4.

Figure 4:
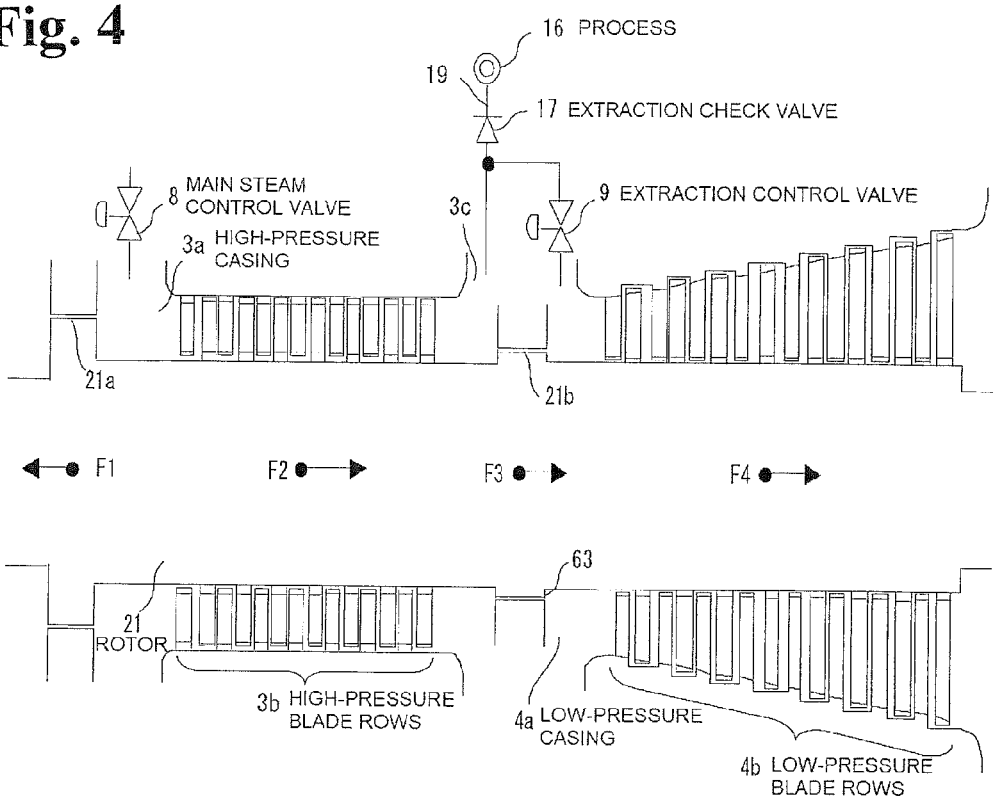
FIG. 4 is a schematic diagram showing a cross section of blade stages in the extraction steam turbine.

FIG. 4 schematically shows cross sections of blade stages parts of the extraction turbine 2.

The pressure of steam flowing from an inlet of the high-pressure part 3 into a high-pressure casing 3*a* through the main steam control valve 8 (high-pressure casing pressure Hp) is determined based on the flow rate of steam passing through high-pressure blade rows 3*b* and the pressure of high-pressure discharged steam. The greater the flow rate of steam passing through the stages is, the higher the pressure.

Rightward thrust force +F2 ("+" indicates the rightward direction) is generated in a turbine rotor 21 by the steam passing through the high-pressure blade rows 3*b*. The high-pressure casing pressure Hp, on the other hand, generates leftward thrusting force –F1 ("–" indicates the leftward direction) on an axial end surface of a rotor boss 21*a* configuring a labyrinth packing.

While some of the high-pressure steam discharged from a high-pressure discharge part 3*c* of the high-pressure part 3 is extracted and supplied to the process 16, the rest of the discharged steam flows into a low-pressure casing 4*a* of the low-pressure part 4 via the extraction control valves 9. As with the pressure Hp described above, the greater the flow rate of steam passing through low-pressure blade rows 4*b*, the higher a pressure LP of the low-pressure casing 4*a*. Thrust force +F4 is acted on the low-pressure blade rows 4*b* by the steam passing therethrough. In addition, thrust force +F3 acts on an axial end surface of a rotor boss 21*b* configuring an intermediate labyrinth packing due to the difference between the low-pressure casing pressure Lp and the pressure of the high-pressure discharged steam. To sum it up, thrust force F acting on the entire turbine rotor can be expressed in the following formula (1):

$$F=F2+F3+F4-F1 \quad (1).$$

Figure 5:
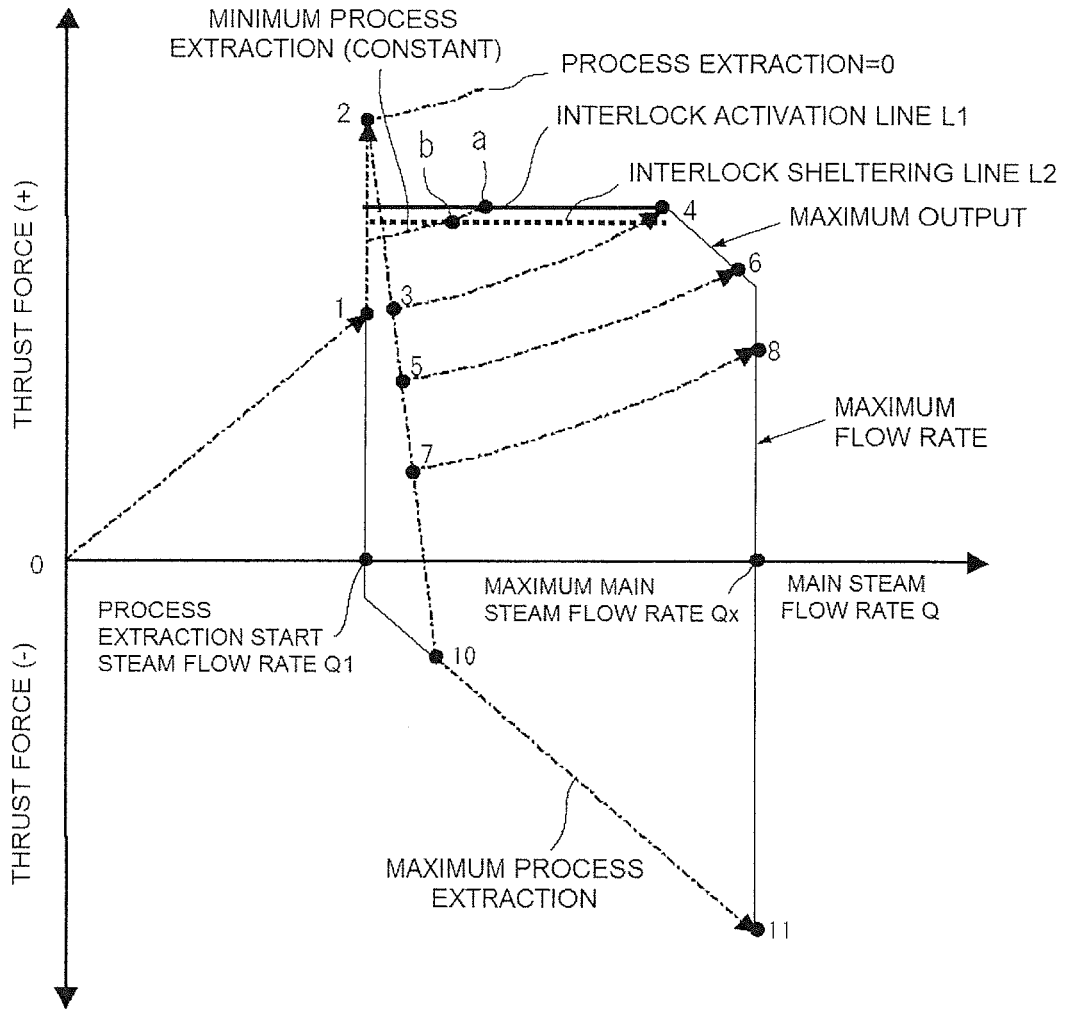
FIG. 5 is a diagram for explaining normal operational state of the extraction steam turbine.

With reference to FIGS. 4 and 5, the change of the thrust force depending on the operational state is described next.

FIG. 5 shows a relationship between a main steam flow rate Q and the thrust force F acting on the turbine rotor, the main steam flow rate Q being shown on the horizontal axis and the thrust force F on the vertical axis.

During start-up of the turbine, the F2 and F4 increase in proportion to the main steam flow rate Q as load increases, i.e., as the main steam flow rate Q increases. The thrust force F acting on the entire turbine rotor, therefore, increases along line 0-1 shown in FIG. 5. Meanwhile, the extraction control valves 9 have their valve openings operated into a wide open position in manual mode (manually by an operator), which consequently supplies the entire high-pressure discharged steam, discharged from the high-pressure part 3 of the extraction turbine 2, to the low-pressure part 4 via the extraction control valves 9. Thus, there flows zero extraction steam.

Once the main steam flow rate Q increases to reach main steam flow rate Q1 that is set as main steam flow rate at which extraction to the process 16 begins (referred to as "extraction start steam flow rate," hereinafter), the manual mode for controlling the extraction control valves 9 is switched to automatic control mode in order to automatically control the pressure of extraction steam, the automatic control mode being executed by the PLC 42. As a result, the opening of the extraction control valves 9 decreases, and the pressure of the high-pressure discharged part 3*c* rises up to the pressure Pp of the process 16.

Note that the entire amount of the high-pressure discharged steam 3*c* is continuously supplied to the low-pressure blade rows 4*b* through the extraction control valves 9 until the pressure of the high-pressure discharged steam 3*c* reaches the pressure Pp of the process 16.

Meanwhile, the pressure Pp of the process 16 is higher than the pressure Hp of the high-pressure discharged steam 3*c*, and an extraction check valve 17 provided in the extraction pipe 19 prevents the steam from flowing from the process 16 back to the extraction turbine 2.

Until the extraction control valves 9 are controlled in the automatic control mode so that a constant level of extraction is performed, the thrust force F increases drastically along line 1-2 shown in FIG. 5 in which an increment of the thrust force F3 added to the intermediate rotor boss 21*b*, which results from increase of the pressure of the high-pressure discharged part 3*c*, overlaps with an increment of the thrust force F4 added to the low-pressure blade rows 4*b*, which results from an increase in the flow rate of steam passing through the low-pressure part 4.

Once the pressure Hp of the high-pressure discharged part 3*c* rises to reach the pressure Pp of the process 16 and extraction steam is supplied to the process 16 as a result of the decrease in the opening of the extraction control valves 9, the flow rate of steam passing through the extraction control valves 9 and the flow rate of steam passing through the low-pressure blade rows 4*b* decrease, reducing the thrust force +F4 acting on the turbine rotor. Consequently, the thrust force F acting on the entire turbine rotor drops along, for example, line 2-3 shown in FIG. 5. When the load (power output) of the extraction turbine 2 is increased while keeping the flow rate of the extraction steam supplied to the process 16 is kept constant, the thrust force +F2 added to the high-pressure blade stages 3*b* and the thrust force +F4 added to the low-pressure blade row 4*b* increase drastically due to the increase in the flow rate of steam flowing through the high-pressure blade stages 3*b* and the flow rate of the steam flowing through the low-pressure blade rows 4*b*, and at the same time the thrust force −F1 added to the rotor boss 21*a* increases drastically due to the increase of the high-pressure casing pressure Hp. Therefore, the thrust force F increases moderately along line 3-4.

Because the more the extraction steam flow rate increases, the lower the thrust force +F4 added to the low-pressure blade rows 4*b* becomes, the thrust force F acting on the entire turbine rotor 21 shifts toward the negative direction (downward, in FIG. 5). When the load is increased while keeping the flow rate of extraction steam constant, the thrust forces +F2 and +F4 increase due to the increase in the flow rate of the steam flowing through the high-pressure blade stages 3*b* and the low-pressure blade stages 4*b*, and consequently the thrust force F acting on the entire turbine rotor shifts toward the positive direction (upward, in FIG. 5) along, for example, line 5-6 and line 7-8 as the load increases.

However, because the flow rate of the steam flowing through the low-pressure blade rows 4*b* decreases as the extraction steam flow rate increases, the thrust force +F4 drops, and consequently the increase of the thrust force −F1 on the rotor boss 21*a* caused by the increase in the high-pressure casing pressure Hp becomes dominant. When the extraction steam flow rate reaches its maximum flow rate, the thrust force F acting on the entire turbine rotor changes drastically toward the negative direction along line 10-11 of FIG. 5 as the main steam flow rate increases.

The thrust force F acting on the extraction turbine 2 changes in the positive (rightward) direction and the negative (leftward) direction in this manner in accordance with increase or decrease of the extraction steam flow rate.

An axial movement of the rotor caused by the thrust force F is restricted by a thrust bearing. When the thrust bearing receives an excessive level of thrust force F which exceeds a permissible value, there is a risk of damage to the thrust bearing. In a case where the thrust bearing were damaged, the safety apparatus should be actuated to stop the extraction turbine on emergency, resulting in a significant loss in the operation of the power generation plant.

Certain flow rate of steam that is required to meet the demand of the process 16 is extracted and supplied from the extraction turbine to the process 16, but the changes in thrust force in the extraction turbine are an internal phenomenon occurring in the extraction turbine, which is in no way found out by the operator of the power generation plant, let alone an operator of the process that uses the extracted steam, and are therefore not taken into consideration when operating the power generation plant. However, in a case where the steam demand of the process changes in a wide variation range, the thrust force F changes in both the negative and positive directions when the process extraction steam flow rate is the lowest and highest. In such a case, the extraction turbine is often designed in consideration of the maximum usage limit of the thrust bearing.

In this case, the thrust force F exceeds the usage limit when the extraction turbine is operated between zero process extraction steam flow rate and the minimum process extraction steam flow rate (referred to as "minimum extraction flow rate," hereinafter). Therefore, in an extraction pressure control operation, the operator of the extraction turbine power generation plant needs to constantly monitor the operational state thereof so that the flow rate of the extraction steam supplied to the process 16 does not drop to the minimum extraction flow rate or lower.

However, when the process extraction steam flow rate drops to the minimum extraction flow rate or lower due to, for example, a drastic decrease in steam demand of the process or for some other reasons during the extraction pressure control operation of the extraction turbine, it is impossible to completely prevent damage to the thrust bearing because the operator does not necessarily take appropriate measures to prevent it.

The present invention is designed to prevent damage to the thrust bearing of the extraction turbine without relying on the alertness of the operator in case of such an abnormal situation, and while minimizing the impact of the process, which uses extraction steam, on the operation of the turbine.

Next, a safety action is described that is executed by the PLC 42 in such safety operation for preventing damage to the thrust bearing.

Figure 7:
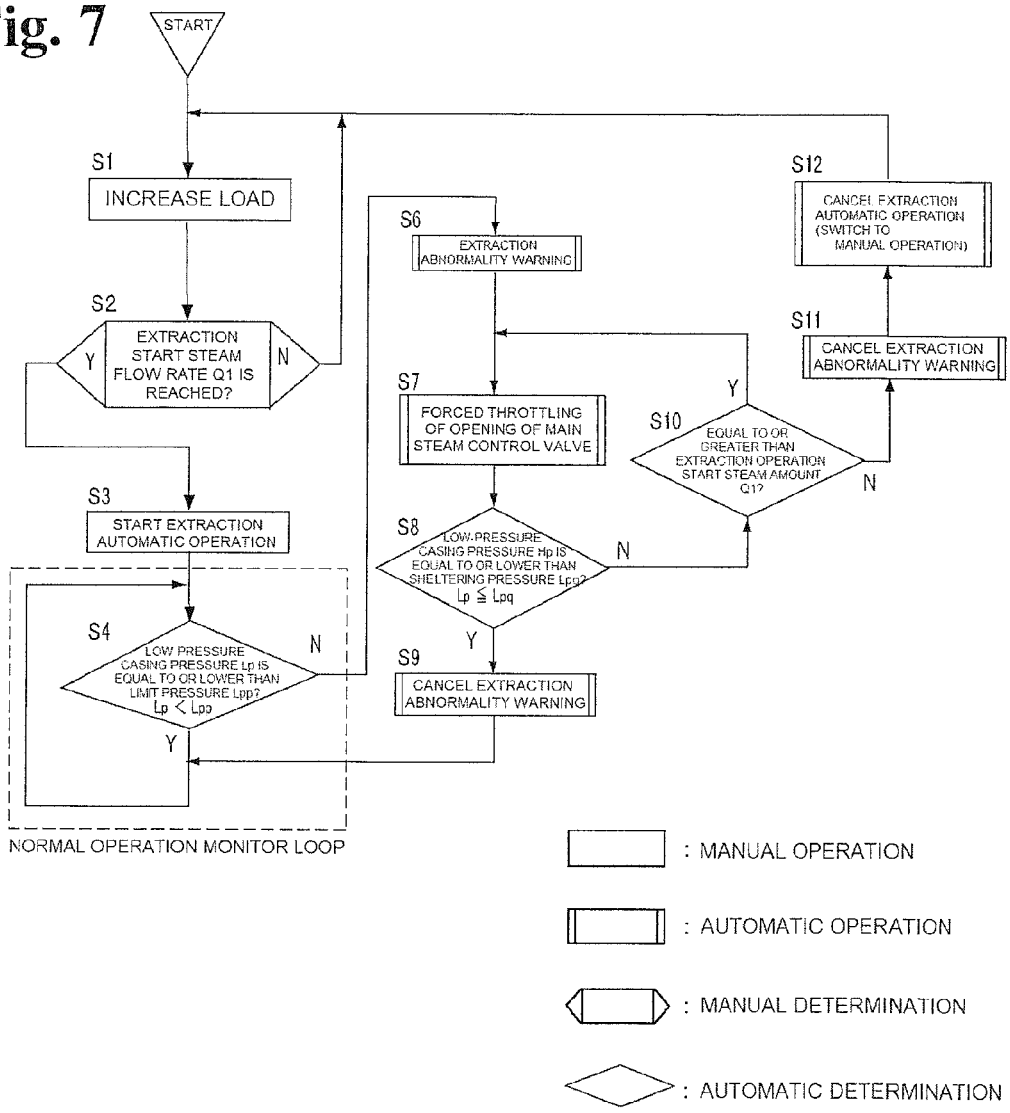
FIG. 7 is a safety action flowchart showing a safety operation method according to the first embodiment of the present invention.

FIG. 7 is a safety action flowchart showing the safety operation of the extraction turbine according to the first embodiment of the present invention.

Step S1 shown in FIG. 7 represents a load increase operation step for manually increasing the main steam flow rate Q to the extraction start steam flow rate Q1 in order to automatically control the pressure of the extraction steam after the start-up of the extraction turbine.

During this step, the main steam flow rate Q is monitored manually, i.e., by the operator (step S2). The load increase operation of step S1 is performed in this main steam flow rate e monitoring step until the main steam flow rate Q reaches the prescribed extraction start steam flow rate Q1 (branching off at "N").

Once the operator determines that the main steam flow rate Q reaches the Q1, the step branches off at "Y" and proceeds to step S3 where the operation mode of the turbine is switched to the extraction pressure control operation. This is normally performed by pushing a button on a console panel. From this step on, the safety operation by the PLC 42 shown in FIG. 1 begins, and the extraction pressure control operation is executed in which the extraction steam pressure is controlled to match prescribed pressure.

After switching the operation mode to the extraction pressure control operation in step S3, the PLC 42 is caused to constantly read the high-pressure casing (steam) pressure Hp, the low-pressure casing (steam) pressure Lp, and the extraction (steam) pressure Pp that are detected respectively by the high-pressure casing pressure detector 40, the low-pressure casing pressure detector 41, and the extraction pressure detector 48, to obtain a low-pressure casing limit pressure Lpp and perform the extraction pressure control, supplying extraction steam of a constant pressure to the process.

Figure 3:
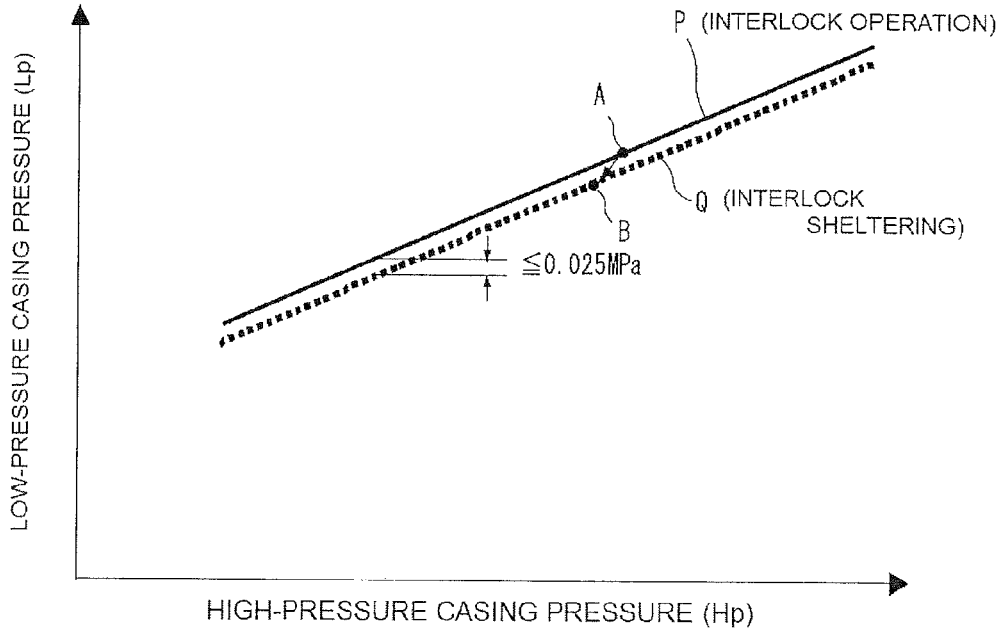
FIG. 3 is a diagram showing special relation between the pressure of the high-pressure casing and the pressure of the low-pressure casing, the pressures being used in safety operation of the extraction steam turbine.

The low-pressure casing limit pressure Lpp is obtained arithmetically as a limit pressure of the low-pressure casing which is delivered in relation to each of the high-pressure casing detection pressures Hp that are read from the pressure correlation line P of FIG. 3 stored beforehand in the PLC 42, based on which is determined the low-pressure casing limit pressure Lpp in relation to each high-pressure casing pressure Hp.

The subsequent step S4 is a step of monitoring the low-pressure casing pressure Lp. Monitoring the low-pressure casing pressure Lp is all about monitoring the thrust force F added to the thrust bearing of the extraction turbine. In this step, the low-pressure casing limit pressure Lpp that is obtained in relation to each high-pressure casing pressure Hp is compared with each of the detected low-pressure casing pressures Lp, and the magnitude relation of the comparison results is determined.

Figure 2:
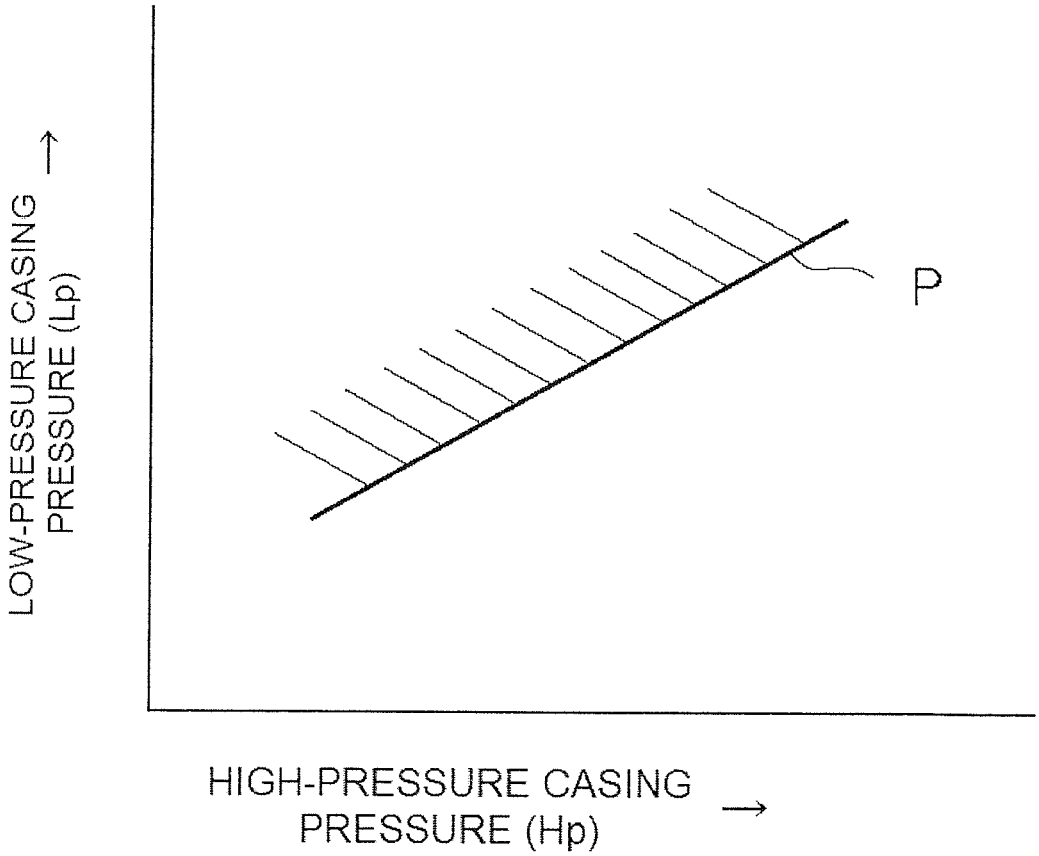
FIG. 2 is a diagram showing correlation between pressure of a high-pressure casing of a high-pressure part of an extraction steam turbine and pressure of a low-pressure casing of a low-pressure part of the same.

In other words, when the low-pressure casing pressure Lp is low and such relation as Lp<Lpp is established, it means that the low-pressure casing pressure Lp is below the pressure correlation line P shown in FIG. 3 (same as the correlation line P of FIG. 2 that shows the low-pressure casing reference pressure), the range in which the thrust force F added to the thrust bearing of the extraction turbine does not interfere with the operation of the extraction turbine. On the other hand, when the low-pressure casing pressure Lp increases and such relation as Lp≥Lpp is established, it means that the low-pressure casing pressure Lp is above the correlation line P shown in FIG. 3, the range in which the thrust force F added to the thrust bearing of the extraction turbine interferes with the operation of the extraction turbine.

Monitoring the low-pressure casing pressure Lp in this manner enables judgment of whether or not the thrust force F acting on the thrust bearing of the extraction turbine falls within the range in which it interferes with the operation of the extraction turbine.

When it is determined in step S4 that the low-pressure casing pressure Lp is lower than the low-pressure casing limit pressure Lpp (Lp<Lpp), the low-pressure casing pressure Lp is below the pressure correlation line P shown in FIG. 3, the range in which the thrust force F added to the thrust bearing of the extraction turbine does not interfere with the operation of the extraction turbine. This means that the result of step S4 is "Y" in a normal load operation monitor loop, continuing the normal load operation.

When it is determined that the low-pressure casing pressure Lp is equal to or greater than the low-pressure casing limit pressure Lpp (Lp≥Lpp), the low-pressure casing pressure Lp is on the correlation line P shown in FIG. 3 (e.g., at a point A shown in the same diagram) or rises thereabove, the range in which the thrust force F added to the thrust bearing of the extraction turbine interferes with the operation of the extraction turbine. In this case, therefore, the normal load operation of the extraction turbine (the load control operation by the main steam control valve) is interlocked (discontinued) immediately, so the step S4 branches off at "N" thereof to proceed to step S6 of an interlock action loop. In step S6, since the process extraction steam flow rate decreases to the minimum extraction flow rate or lower, an extraction abnormality warning is issued to inform that excessive thrust force F is added to the thrust bearing of the extraction turbine.

It should be noted that the point A shown in FIG. 3 corresponds to the thrust force indicated by a point a on an interlock activation line (a line indicating the limit of the thrust force) L1 shown in FIG. 5.

Subsequent to the issuance of the warning in step S6, the flowchart immediately proceeds to step S7 where a forced throttling action is executed to forcibly throttle the opening of the main steam control valve 8 while continuing the extraction pressure control. This step is performed for the purpose of preventing the excessive thrust force on the extraction turbine from damaging the thrust bearing, and reduces the thrust force F generated in the extraction turbine 2 by rapidly throttling the opening of the main steam control valve 8.

Throttling the opening of the main steam control valve 8 reduces the flow rate of the main steam supplied to the extraction turbine 2 and the flow rate of the steam passing through the high-pressure blade rows 3*b* and the low-pressure blade rows 4*b*, which, consequently, lowers the high-pressure casing pressure Hp and the low-pressure casing pressure Lp, and hence the thrust force F generated in the extraction turbine 2.

As a result of this action, it is judged in step S8 whether the thrust force generated in the extraction turbine drops to fall within a safety range in which the thrust force does not interfere with the operation of the extraction turbine. Specifically, step S8 executes a process for comparing the low-pressure casing pressure Lp detected by the low-pressure casing pressure detector 41 with a low-pressure casing sheltering pressure Lpq and then judging whether the Lp is equal to or lower than the Lpq. The low-pressure casing sheltering pressure Lpq is obtained based on a second pressure correlation line Q that expresses a special relation between the high-pressure casing pressure Hp and the low-pressure casing sheltering pressure Lpq, the high-pressure casing pressure Hp being reduced by, for example, 0.025 Mpa, a pressure slightly lower than the correlation line P shown in FIG. 3. When it is judged in this judging process that the low-pressure casing pressure Lp drops to the low-pressure casing sheltering pressure Lpq or lower (Lp≤Lpq) and becomes a value below the correlation line Q, the step branches off at "Y" to proceed to step S9 where the forced throttling action on the main steam control valve 8 is stopped and the extraction abnormality warning cancellation process is executed, entering the normal load operation monitor loop.

In the example shown in FIG. 3, the forced throttling action executed on the main steam control valve is stopped when a point B is reached.

This point corresponds to the thrust force indicated by a point b on line L2 shown in FIG. 5.

When it is judged in step S8 that the low-pressure casing pressure Lp is higher than the low-pressure casing sheltering pressure Lpq, it means that the low-pressure casing pressure Lp is above the line Q shown in FIG. 3. The step therefore branches off at "N" to proceed to step S10.

In step S10, the main steam flow rate Q that is reduced as a result of forcibly throttling the main steam control valve 8 is compared with the extraction start steam flow rate Q1, to judge whether the main steam flow rate Q is equal to or greater than the extraction start steam flow rate Q1. When it is judged that the main steam flow rate Q is equal to or greater than the extraction start steam flow rate Q1 and is not reduced to the extraction start steam flow rate Q1 or lower, the step branches off at "Y" to return to step S7, and the forced throttling action is repeatedly performed on the main steam control valve 8 until the low-pressure casing pressure Lp becomes equal to or lower than the low-pressure casing sheltering pressure Lpq.

When the low-pressure casing pressure Lp becomes equal to or lower than the low-pressure casing sheltering pressure Lpq and is positioned on or moves below the pressure correlation line Q shown in FIG. 3 as a result of the forced throttling operation performed on the main steam control valve 8, it means that the thrust force F acting in the extraction turbine drops to the range in which it does not interfere with the operation of the extraction turbine. In step S8, therefore, as soon as it is judged that the low-pressure casing pressure Lp is positioned on or below the correlation line Q shown in FIG. 3, the step branches off at "Y" and leaves the loop of steps S7, S8 and S10 associated with the execution of the forced throttling operation on the main steam control valve 8, to proceed to step S9. Through the warning cancellation process in step S9, the normal load operation monitor loop is started again to continue the normal load operation, and load operation is performed by the main steam control valve with the load at which the main steam control valve 8 is forcibly throttled in step S7.

When wishing to return to the original load, the operator, after transferring to the normal load operation, carries out the load increase operation as soon as confirming that the process extraction steam flow rate becomes equal to or greater than the minimum extraction flow rate.

When, on the other hand, the main steam flow rate Q drops significantly and becomes equal to or lower than the extraction start steam flow rate Q1 during the process of throttling the main steam control valve 8 in the loop of steps S7, S8 and S10, the extraction pressure control operation cannot be continued. Thus, step S10 branches off at "N" to proceed to steps S11 and S12 in which the extraction abnormality warning cancellation process is executed and thereafter an extraction pressure control operation cancellation process is performed. Subsequently, returning to step S1 (the load increase operation performed by the operator), the operation mode is switched to the extraction pressure control operation again.

Note that the reason why it is determined in step S4 that the low-pressure casing pressure Lp is greater than the low-pressure casing limit pressure Lpp, is because the extraction flow rate is not enough in the load obtained at that moment or, specifically, because steam in terms of the flow rate corresponding to the minimum extraction flow rate, is not supplied from the high-pressure discharge part 3*c* (FIG. 4) to the process 16.

For this reason, when the extraction abnormality warning is issued, the operator can reduce the low-pressure casing pressure Lp by executing the operation for increasing the flow rate of extraction steam supplied from the high-pressure discharge part 3*c* to the process 16 by increasing the process demand (steam flow rate), so that the low-pressure casing pressure Lp becomes equal to or lower than the low-pressure casing sheltering pressure Lpq in step S8. In this manner, the step can proceed to step S9.

The present invention is configured to be able to stop the forced throttling action on the main steam control valve, in the middle thereof, to return to the normal load operation, by allowing the operator to increase the extraction flow rate. This is one of the features that are not available in the prior art.

The present invention is also configured to change the flow rate of steam passing through the main steam control valve and the extraction control valves 9, while maintaining a constant relation between the valve opening of the main steam control valve 8 and the valve opening of the extraction control valves 9, even during a period in which the valve opening command sent from the PLC 42 to the main steam control valve 8 changes in the process of forcibly throttling the valve opening of the main steam control valve 8. According to such configuration, even when the main steam flow rate changes as a result of forcibly throttling the valve opening of the main steam control valve 8, the flow rate of the extraction steam supplied to the process can be kept constant without being influenced by the change.

Figure 6:
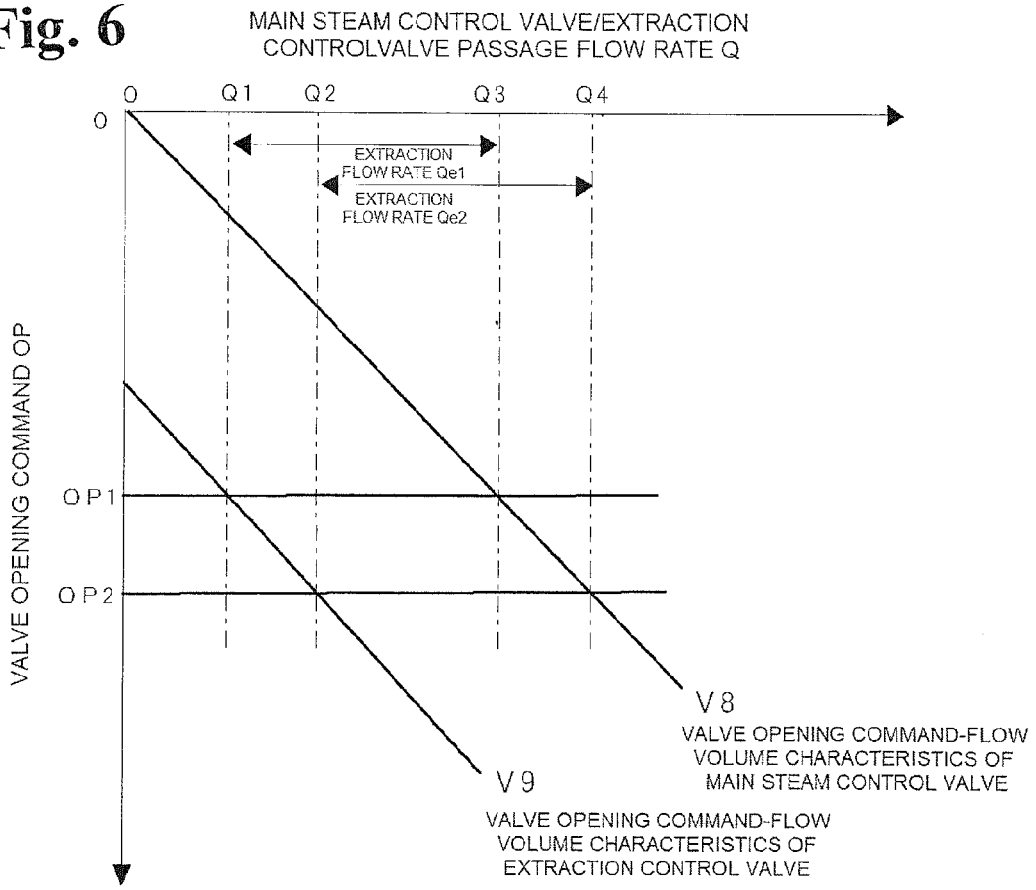
FIG. 6 is a diagram showing relation among valve opening command, main steam control valve, and flow rate of steam passing through an extraction control valve.

FIG. 6 shows a relation between a valve opening command OP and the flow rate Q of steam passing through the main steam control valve 8 and the extraction control valves 9, wherein a characteristic line V8 represents valve opening command-valve passage flow rate characteristics of the main steam control valve 8, and a characteristic line V9 represents valve opening command-valve passage flow rate characteristics of the extraction control valves 9.

With respect to a certain steam demand of the process, the valve opening of the main steam control valve 8 and the extraction control valves 9 are on the characteristic lines V8 and V9 that are parallel to each other as shown in FIG. 6, and this relation does not change even when the load changes, as long as the steam demand of the process does not change. When the valve opening command OP being to be sent to the main steam control valve 8 changes due to change in the load, the same valve opening command OP is issued to the extraction control valves 9. Therefore, the extraction flow rate, which is the difference between the flow rate of steam passing through the main steam control valve 8 and the flow rate of steam passing through the extraction control valves 9, is kept constant.

Similarly, when the main steam control valve 9 is in the forced throttling loop of step S7 shown in FIG. 7, and the valve opening command OP is changed, the extraction flow rate is kept unchanged and constant.

For instance, when the flow volume of the extraction steam supplied to the process 16 is reduced for some reason while the main steam control valves 8 and the extraction steam control valves 9 are operated with a valve opening command OP2, the flow rate of steam passing through the low-pressure blade rows 4*b* increases, and consequently the low-pressure casing pressure Lp increases. Then, when the Lp reaches the point A on the pressure correlation line P shown in FIG. 3, it is judged in step S4 of FIG. 7 that the Lp is equal to or greater than the Lpp, and the valve opening of the main steam control valve 8 is forcibly throttled. As a result, the main steam flow rate decreases. When the low-pressure casing pressure Lp drops and reaches the point B on the pressure correlation line P shown in FIG. 3, it is judged in step S8 of FIG. 7 that the Lp is equal to or lower than the Lpq, and the step branches off at "Y" to proceed to step S9 where the extraction abnormality warning is canceled. The valve opening command for the main steam control valve 8 is changed from OP2 to OP1 in FIG. 6 at this moment, but the valve opening command for the extraction control valves 9 is also changed from OP2 to OP1 at the same time. In other words, the relation between the valve opening command-valve passage flow rate characteristic line V8 of the main steam control valve and the valve opening command-valve passage flow rate characteristic line V9 of the extraction control valves 9 is maintained in such a manner that the difference in the passage flow rate between the valves is kept constant even during the period when the valve opening command is changed from OP2 to OP1.

The flow rate of the extraction steam supplied to the process 16 during this period is kept constant as described below.

As shown in FIG. 6, the flow rate of the steam passing through the main steam control valve 8 becomes Q4, and the flow rate of the steam passing through the extraction control valves 9 Q2, at the time of the valve opening command OP2.

The flow rate of the extraction steam supplied to the process 16 corresponds to the difference Qe2 between the flow rate Q4 of the steam passing through the main steam control valve 8 and the flow rate Q2 of the steam passing through the extraction control valves 9 (Qe2=Q4−Q2).

On the other hand, the flow rate of the steam passing through the main steam control valve 8 is reduced to Q3 as a result of the decrease of the valve opening command OP from OP2 to OP1 according to the determination on the low-pressure casing pressure Lp. In this case, the valve opening command for the extraction control valves 9 is also reduced to OP1 by the same ratio, and the flow rate of the steam passing through the extraction control valves 9 decreases to Q1. Thus, the flow rate Qe1 of extraction steam supplied to the process corresponds to the difference between the flow rate Q3 of the steam passing through the main steam control valve 8 and the flow rate Q1 of the steam passing through the extraction control valves 9 (Qe1=Q3−Q1), which is equal to the flow rate Qe2 of extraction steam supplied to the process at the time of the valve opening command OP2.

According to the first embodiment of the present invention described above, in the extraction pressure control automatic operation in which the extraction turbine has a predetermined level of load, the low-pressure casing pressure of the low-pressure part of the extraction turbine is detected, and when this low-pressure casing pressure becomes greater than the low-pressure casing limit pressure that is determined in accordance with each of the prescribed high-pressure casing pressures, the opening of the main steam control valve is forcibly throttled to reduce the flow rate of steam flowing into the high-pressure part of the extraction turbine, while the extraction pressure control is continued. In this manner, the thrust force acting on the turbine rotor can be kept low while continuing the supply of the extraction steam.

In this action it is determined automatically whether the thrust force is dropped to the safety range in which it does not interfere with the operation of the extraction turbine. When it is judged that the thrust force is dropped to the safety range, the forced throttling operation on the main steam control valve is stopped, and the normal load operation for controlling the main steam flow rate by the main steam control valve 8 can be restarted under this load.

This configuration can not only reduce the impact on the supply of the extraction steam to the plant and on the supply of electric power to the electric power network system, but also prevent excessive thrust force from damaging the thrust bearing of the extraction turbine, enabling safe operation of the extraction turbine.

Second Embodiment

Second embodiment of the present invention is described next.

The pressure of the high-pressure discharged steam discharged from the high-pressure discharge part 3*c* is lower than the steam pressure Pp of the process, immediately before switching the operation mode to the extraction pressure control operation. However, switching the operation mode to the extraction pressure control operation leads to throttling of the extraction control valves 9, which increases the pressure of the high-pressure discharged steam. When the pressure of the high-pressure discharged steam rises to or above the steam pressure of the process, extraction takes place. On the other hand, the entire or most of the high-pressure discharged steam discharged from the high-pressure discharge part 3*c* flows to the low-pressure blade rows 4*b* during the period between immediately after switching the operation mode and when a certain level of extraction is carried out. This increases the low-pressure casing pressure Lp. When the low-pressure casing pressure Lp is equal to or greater than the low-pressure casing limit pressure Lpp that is determined based on the pressure correlation line P shown in FIG. 3, the forced throttling operation is likely to be executed on the main steam control valve 8. At this moment, the thrust force is as great as a point 2 shown in FIG. 5. Although this is temporary and therefore acceptable, executing the forced throttling action on the main steam control valve 8 each time when switching the operation mode to the extraction pressure control operation, complicates the whole operation because the operation for canceling the forced throttling action needs to be executed.

Second embodiment is designed to resolve such complexity.

Figure 10:
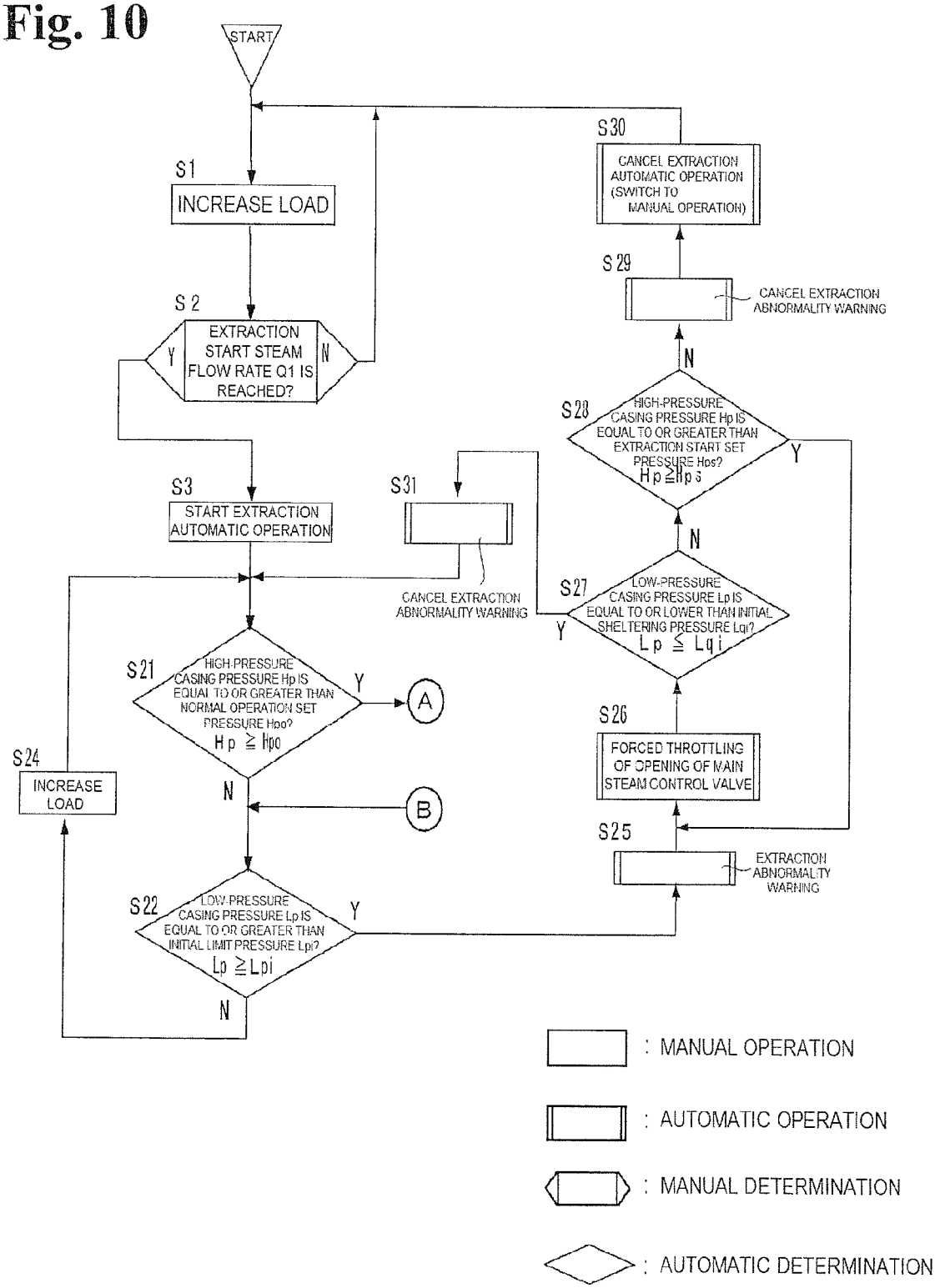
FIG. 10 is a partial safety action flowchart showing a safety operation method according to the second embodiment of the present invention.
Figure 11:
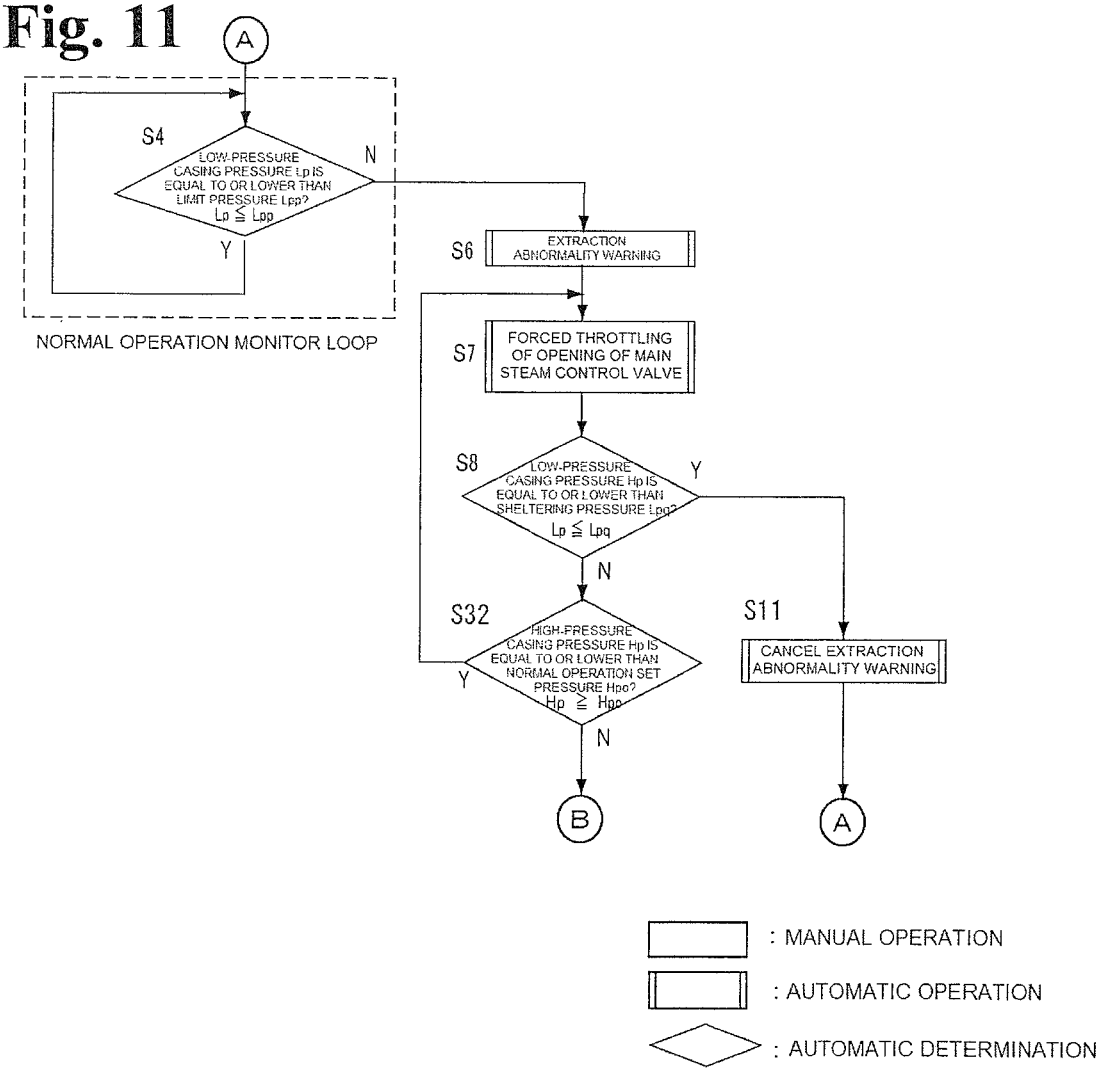
FIG. 11 is a partial safety action flowchart, a continuation of the flowchart shown in FIG. 10, according to the second embodiment of the present invention.
Figure 12:
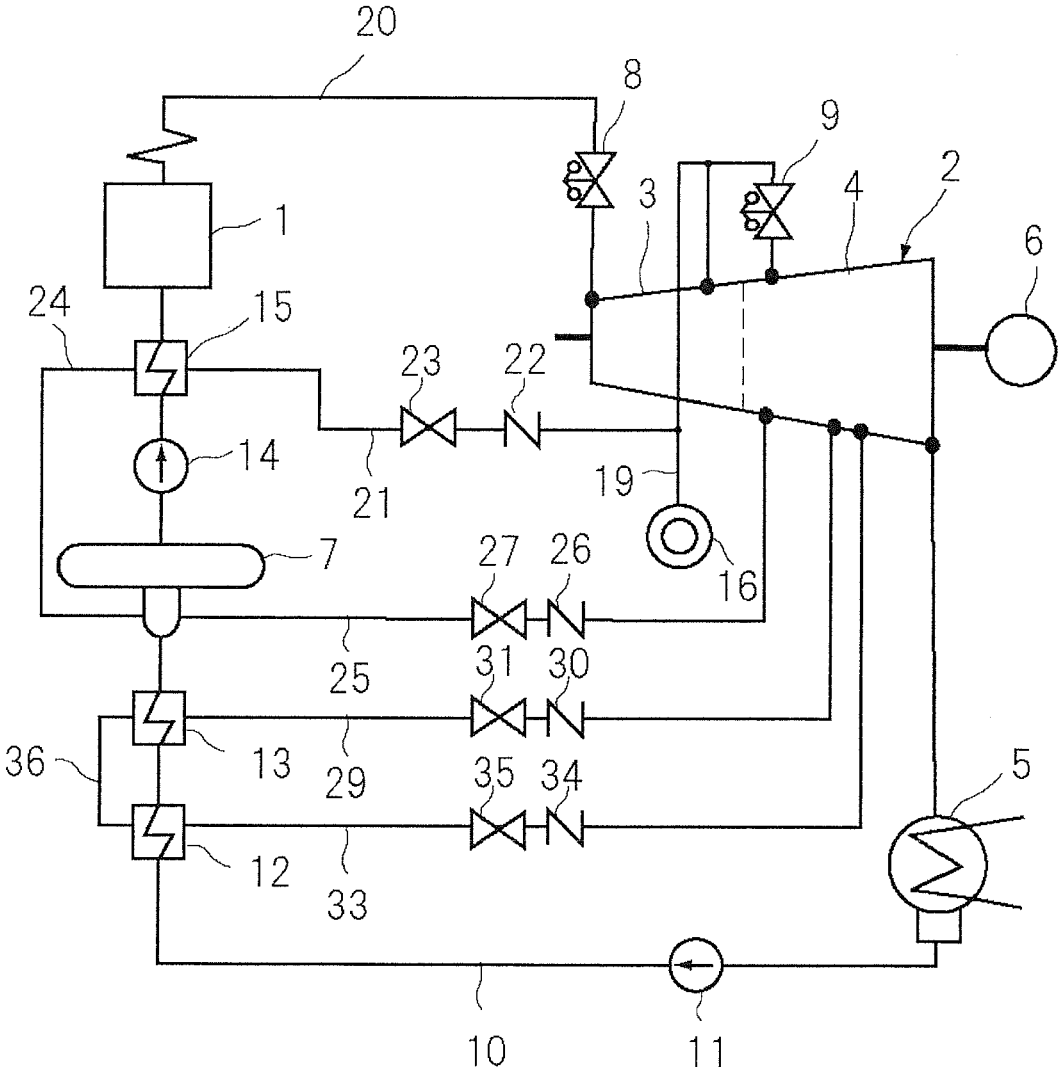
Fig. 12 Prior Art
FIG. 12 is a system diagram showing a general extraction steam turbine plant.
Figure 13:
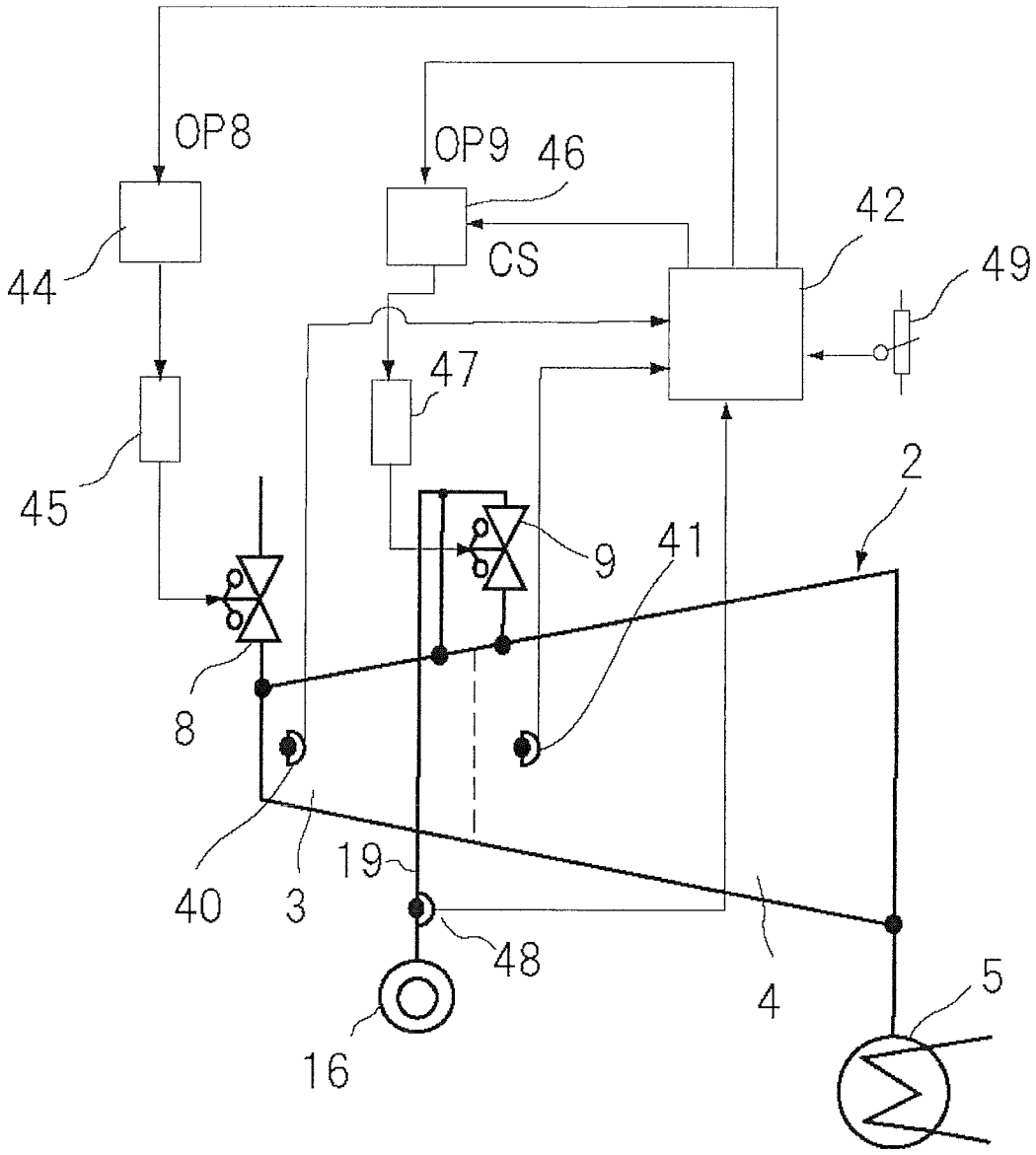
Fig. 13 Prior Art
FIG. 13 is a system diagram of an extraction steam turbine plant with a conventional safety operation apparatus.

The second embodiment may be obtained by changing a part of the safety action flow of the first embodiment shown in FIG. 7. FIGS. 10 and 11 each show the modified safety action flow according to the second embodiment.

In the safety action flow according to the second embodiment, the steps denoted by the same symbols as those of the safety action flow of the first embodiment represent the same processes or operations as those of the safety action flow of the first embodiment.

The manual start-up operation shown in FIG. 10 that is executed between the load increase operation of step S1 and switching of the operation mode to the extraction pressure control operation in step S3 is same as that illustrated in the first embodiment (FIG. 7).

Figure 8:
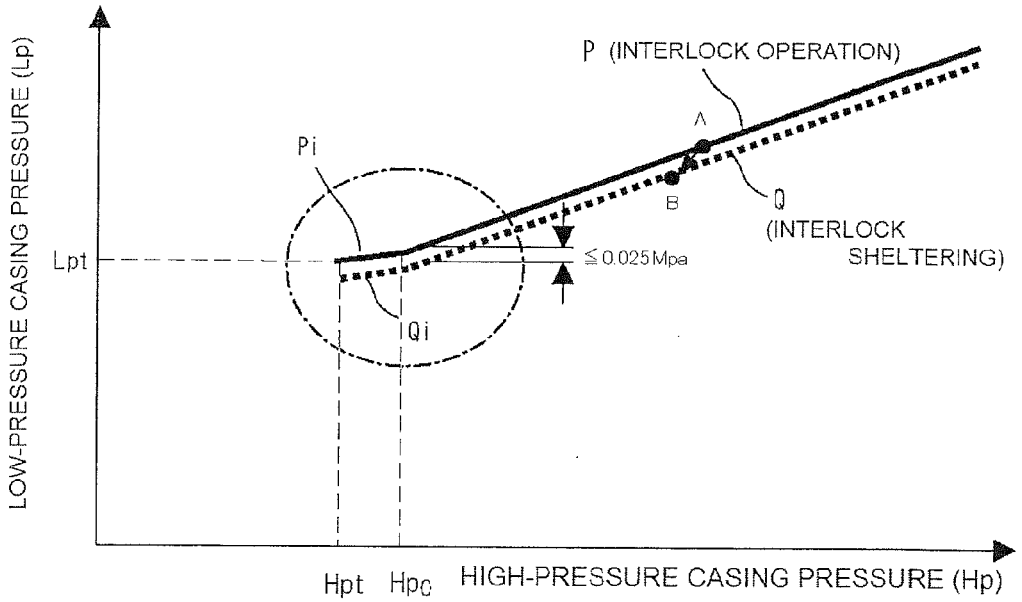
FIG. 8 is a diagram showing, along with the pressure correlation line of FIG. 3, an initial pressure correlation line expressing a specific relation between high-pressure casing pressure and low-pressure casing limit pressure that are used in an initial safety operation performed at the time of switching an operation mode of the extraction steam turbine to extraction control.

In place of the Lpp and Lpq, which are the values shown on the pressure correlation lines P and Q in FIG. 3, the second embodiment uses an initial low-pressure casing limit pressure Lpi and an initial low-pressure casing sheltering pressure Lqi in the extraction pressure control operation, the pressures Lpi and Lqi being values shown on initial pressure correlation lines (the circled part in FIG. 8) Pi and Qi having slopes different from those of the correlation lines P and Q.

The initial pressure correlation lines Pi and Qi are determined as follows.

Figure 9:
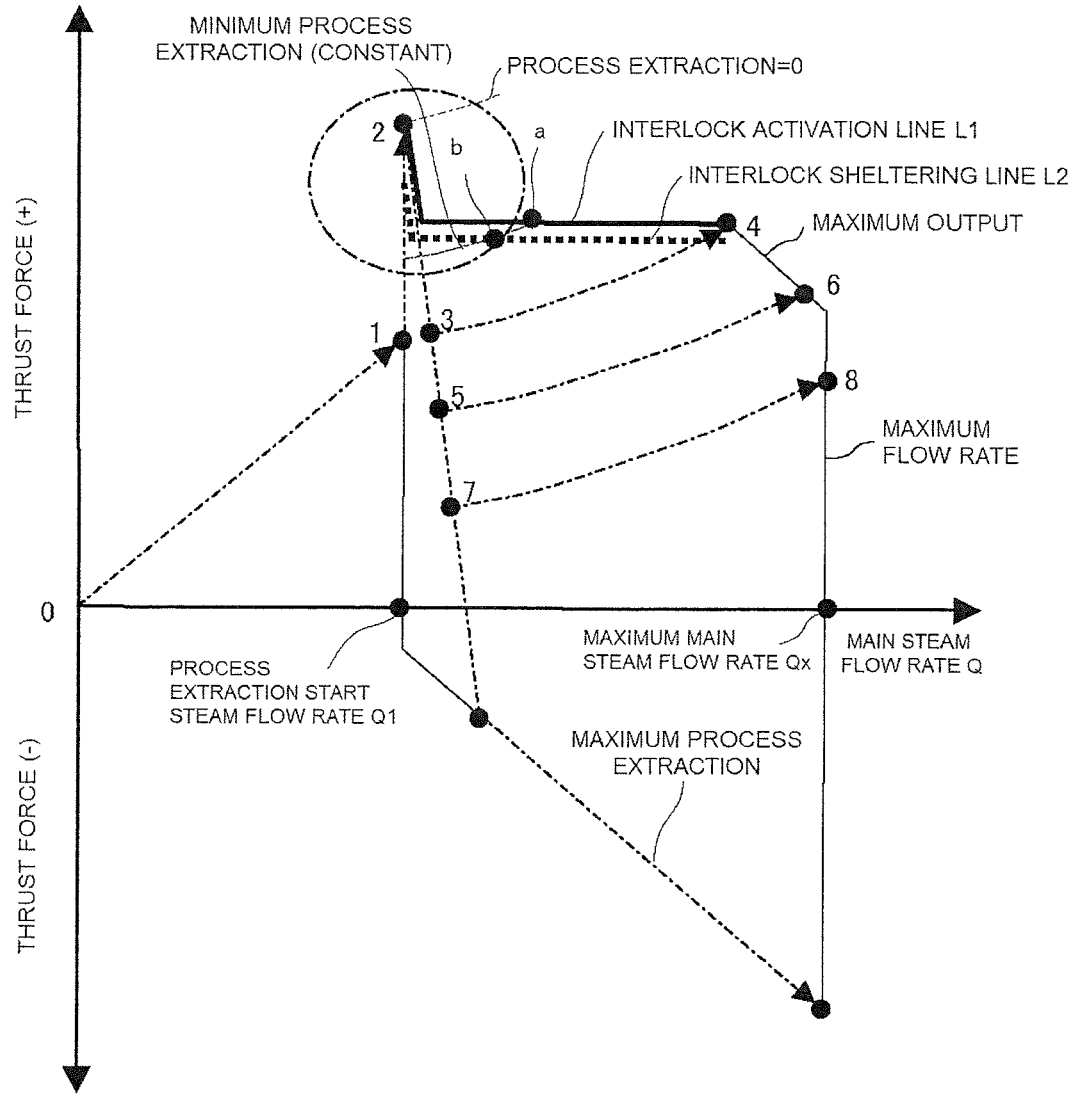
FIG. 9 is a diagram for explaining an operational state that includes a start-up state of the extraction steam turbine.

The low-pressure casing pressure Lp that generates thrust force, shown by point 2 in FIG. 9, which protrudes immediately after switching the operation mode to the extraction pressure control operation (referred to as "projecting thrust," hereinafter), is computed. Because the protruding thrust is generated when the entire main steam flows into the low-pressure blade rows 4*b* when the main steam flow rate is the extraction start steam flow rate Q1 (see paragraph 0043), the Lp is computed from the Q1 (the computed value is referred to as "Lpt").

Then, the high-pressure casing pressure Hp can also be computed from the relation between the Q1 and the extraction pressure (the computed value is referred to as "Hpt"). This can determine a coordinate point of the low-pressure casing pressure in FIG. 8 with respect to the high-pressure casing pressure obtained immediately after the extraction pressure control operation is started. An appropriate line is stretched from the coordinate point (Hpt, Lpt) along the line P in FIG. 8, to obtain a line Pi. A line Qi is a straight line corresponding to a line obtained by slightly moving the line Pi downward in parallel.

The high-pressure casing pressure indicated by the intersection coordinate between the line P and the line Pi is called "normal operation set pressure" Hpo.

The Hpo is determined in consideration of the magnitude of the protruding thrust.

In step S21 to be executed immediately after switching the operation mode to the extraction pressure control operation in step S3, it is judged whether the high-pressure casing pressure Hp reaches the normal operation set pressure Hpo or not.

When the Hp is lower than the Hpo, it means that the high-pressure casing pressure Hp has not yet reached the normal operation set pressure Hpo. Therefore, the step branches off at "N" to proceed to step S22.

In step S22, it is judged whether the low-pressure casing pressure Lp is equal to or greater than the initial low-pressure casing limit pressure Lpi. When the Lp is lower than the Lpi, the step branches off at "N" to execute step S24 of the load increase operation (main steam flow rate increase operation), and then returns to step S21. This operation is repeated until the high-pressure casing pressure Hp reaches the normal operation set pressure Hpo.

When it is determined in step S22 that the Lp is equal to or greater than the Lpi, it means that, due to the increase of the low-pressure casing pressure Lp, the thrust force generated in the extraction turbine falls within the range in which it is excessive and interferes with the operation of the extraction turbine. Thus, the step branches off at "Y" to proceed to step S25 where the extraction abnormality warning is issued. Immediately thereafter, step S26 is executed to forcibly throttle the main steam control valve, reducing the flow rate Q of the main steam supplied to the extraction turbine 2. As a result, the low-pressure casing pressure Lp decreases in response to the decrease of the main steam flow rate Q.

When this operation causes the low-pressure casing pressure Lp to decrease to the initial low-pressure casing sheltering pressure Lqi or lower, step S27 is executed to judge if the low-pressure casing pressure Lp is equal to or lower than the initial low-pressure casing evacuation pressure Lqi. Accordingly, the step branches off at "Y" to proceed to step S31 where the forced throttling action on the main steam regulating valve is stopped and the extraction abnormality warning is canceled. Subsequently, returning to step S21, the high-pressure casing pressure Hp is determined again.

When it is judged in step S27 that the low-pressure casing pressure Lp is not low enough and is still greater than the Lqi, the step S27 branches off at "N" thereof to proceed to step S28 where it is judged whether the high-pressure casing pressure Hp is equal to or lower than prescribed extraction start set pressure Hps.

When it is judged in step S28 that the high-pressure casing pressure Hp is equal to or greater than the extraction start set pressure Hps, the step branches off at "Y" to return to step S26, and the forced throttling operation is performed on the main steam control valve until it is judged d in step S27 that the Lp is equal to or lower than the Lqi.

When it is judged in step S28 that the Hp is lower than the Hps, the step branches off at "N" to proceed to step S29 where the extraction abnormality warning cancelation operation is executed. Subsequently, step S30 is executed to cancel the extraction pressure control operation, i.e., to switch the operation mode to the manual mode, and the step returns to step S1.

When returning to the original load, the operator confirms that the process demands for the minimum extraction steam or more, and starts over the operation for switching the operation mode to the extraction pressure control operation.

On the other hand, when it is judged in step S21 for judging the high-pressure casing pressure Hp that the Hp reaches the normal operation set pressure Hpo and is equal to or greater than the Hpo, it means that the normal operation is possible. Therefore, the step S21 branches off at "Y" thereof to proceed to a point A of a control flow of a normal operation control loop shown in FIG. 11, entering the normal operation control loop.

Although the safety action flow of FIG. 11 for monitoring the normal load operation is substantially the same as the safety action flow of FIG. 7 according to the first embodiment, the difference there is that the flow shown in FIG. 11 is provided with step S32 subsequent to step S8 in which the low-pressure casing pressure Lp is compared with the low-pressure casing sheltering pressure Lpq.

The same judging process as the one of step S21 (FIG. 10) is performed in step S32, and the result "N" thereof leads to a point B of the safety action flow shown in FIG. 10.

According to the flow of FIG. 11 showing the safety action for the normal operation, when it is judged in step S32 that the high-pressure casing pressure Hp is equal to or greater than the Hpo, the step returns to step S7 to configure the loop of the operation for forcibly throttling the main steam regulating valve. This configuration is same as that of the safety action shown in FIG. 7.

When the high-pressure casing pressure Hp decreases and becomes lower than the Hpo as a result of forcibly throttling the main steam regulating valve, step S32 branches off at "N" thereof to return to the point B of FIG. 10, and then the load is increased.

Returning to the point A of the safety action flow after step S11, the normal load operation monitor loop is configured. However, because the load is low in the loop of S7, S8 and S32, the operator confirms that the process extraction steam flow rate is equal to or greater than the minimum extraction flow rate and then increases the opening of the main steam control valve, in order to return to the original load.

The other operations in the safety action flow of FIG. 11 are the same as those of the safety action flow of FIG. 7 according to the first embodiment; therefore, the detailed description thereof is omitted accordingly.

As described above, the second embodiment of the present invention is characterized in that, when switching the operation mode of the extraction turbine to the extraction pressure control operation immediately after starting the extraction steam turbine power generation plant, the initial low-pressure casing limit pressure that is used in the initial state of the operation is set separately from the low-pressure casing limit pressure that is used in the normal load operation, and that these two set values are used depending on the operational state of the extraction turbine, until a certain level of extraction is performed, in order to deal with a situation where the low-pressure casing pressure exceeds the low-pressure casing limit pressure. Thus, according to the second embodiment, even when the low-pressure casing pressure exceeds the low-pressure casing limit pressure after switching the operation mode to the extraction pressure control operation immediately after starting the extraction steam turbine power generation plant, the set value of the low-pressure casing limit pressure for transferring to the forced throttling operation for throttling the main steam control valve (the safety action) is set at the initial low-pressure casing limit pressure that is higher than normal. Such a configuration can not only prevent the transfer to the forced throttling operation for throttling the main steam control valve, but also automatically change the forced throttling operation to the normal operation, resulting in elimination of the complicated operation for canceling the forced throttling operation and hence a significant reduction of the operation burden imposed on the operator.

EXPLANATION OF REFERENCE NUMERALS

2: Extraction steam turbine, 3: High-pressure portion, 4: Low-pressure portion, 8: Main steam regulating valve, 9: Extraction regulating valve, 16: Production process, 19: Extraction pipe, 40: High-pressure casing pressure detector, 41: Low-pressure casing pressure detector, 42: Arithmetic control device, 44: Main steam regulating valve controller, 46: Extraction regulating valve controller, 48: Process pressure detector

What is claimed is:

1. A safety operation method of steam extraction for an extraction steam turbine power generation plant comprising:

a method of the steam extraction including:

controlling a pressure of steam extraction delivered to an extraction steam turbine, wherein the extraction steam turbine comprises a high-pressure part and a low-pressure part, each of the high-pressure part and the low-pressure part having blade stages, the extraction steam turbine power generation plant configured to drive a generator;

controlling a flow rate of steam delivered to the high-pressure part of the extraction steam turbine using a main steam control valve;

adjusting a flow rate of steam discharged from the high-pressure part using an extraction control valve, and supplying at least a portion of the adjusted steam discharge to the low-pressure part; and extracting and supplying at least another portion of the steam discharged from the high-pressure part to a production process; and the safety operation method comprising:

detecting a steam pressure inside a high-pressure casing of the high-pressure part and a steam pressure inside a low-pressure casing of the low-pressure part;

obtaining a low-pressure casing limit pressure, using the low-pressure casing limit pressure as a reference pressure which corresponds to the pressure of the high-pressure casing in each detection based on a pressure correlation line which specifies a predetermined special relation between a preset high-pressure casing pressure and a low-pressure casing pressure of the extraction steam turbine;

comparing the low-pressure casing limit pressure with the detected pressure of the low-pressure casing; and forcibly throttling an opening of the main steam control valve to reduce the flow rate of the steam flowing into the high-pressure part such that the main steam control valve and the extraction control valve continue controlling an operation of the steam extraction when the detected pressure of the low-pressure casing is determined to be higher than the low-pressure casing limit pressure.

2. The safety operation method of steam extraction for an extraction steam turbine power generation plant according to claim 1, further comprising:

discontinuing an operation of throttling the opening of the main steam control valve when the low-pressure casing pressure is higher than the low-pressure casing limit pressure; and restarting a load operation using the main steam control valve under a load corresponding to the opening of the main steam control valve when the flow rate of steam flowing into the high-pressure part is reduced and the detected pressure of the low-pressure casing is lowered equal to or lower than a low-pressure casing sheltering pressure;

wherein the low-pressure casing sheltering pressure is a reference pressure set to be lower than the low-pressure casing limit pressure.

3. The safety operation method of steam extraction for an extraction steam turbine power generation plant according to claim 1, further comprising:

starting-up of the extraction steam turbine power generation plant by maintaining an initial low-pressure casing limit pressure until a flow rate of main steam supplied to the extraction steam turbine reaches a preset flow rate enabling a steady steam extraction pressure control operation, wherein the initial low-pressure casing limit pressure is a reference pressure obtained based on an initial pressure correlation line which is different from the pressure correlation line, for obtaining the low-pressure casing limit pressure for switching to the steam extraction pressure control operation.

4. An apparatus for safety operation of steam extraction for extraction steam turbine power generation plant to control a pressure of the extraction steam to a constant value, the apparatus comprising:

a steam extraction apparatus including:

an extraction steam turbine having a high-pressure part and a low-pressure part each of the high-pressure part and the low-pressure part having blade rows, wherein the extraction steam turbine is configured to drive a generator;

a main steam control valve configured to control a flow rate of steam flowing into the high-pressure part of the extraction steam turbine, and adjust a flow rate of steam discharged from the high-pressure part; and an extraction control valve configured to supply at least a portion of the adjusted steam discharge to the low-pressure part of the steam discharged from the high-pressure part and supply at least another portion of the steam discharged from the high-pressure part to a production process; and a safety operation apparatus comprising:

pressure detection means for detecting a steam pressure inside a high-pressure casing of the high-pressure part and a steam pressure inside a low-pressure casing of the low-pressure part;

means for obtaining a low-pressure casing limit pressure and using the low-pressure casing limit pressure as a reference pressure which corresponds to a pressure of the high-pressure casing in each detection based on a pressure correlation line which specifies a special relation between a preset high-pressure casing pressure and a low-pressure casing pressure of the extraction steam turbine;

means for comparing the detected pressure of the low-pressure casing with the low-pressure casing limit pressure; and control means for throttling an opening of the main steam control valve to reduce the flow rate of steam flowing into the high-pressure part to continue an operation of a pressure control function of the main steam control valve and the extraction control valve when the detected pressure of the low-pressure casing is higher than the low-pressure casing limit pressure.

5. The apparatus for safety operation of steam extraction for extraction steam turbine power generation plant to control a pressure of the steam extraction to a constant value according to claim 4, wherein the control means further commands a valve control to discontinue throttling the opening of the main steam control valve when the detected pressure of the low-pressure casing is higher than the low-pressure casing limit pressure;

the main steam control valve is configured to restart a load operation under a load corresponding to the opening of the main steam control valve when the low-pressure casing pressure becomes equal to or lower than a low-pressure casing sheltering pressure; and the low-pressure casing sheltering pressure is a reference pressure set to be lower than the low-pressure casing limit pressure by a predetermined value.

6. The apparatus for safety operation of steam extraction for extraction steam turbine power generation plant to control a pressure of the steam extraction to a constant value according to claim 4, further comprising:

means for implementing setting of the apparatus such that upon starting-up of the extraction steam turbine power generation plant, an initial low-pressure casing limit pressure is maintained until a flow rate of main steam supplied to the extraction steam turbine reaches a flow rate that is preset as a main steam flow rate so as to enable continuation of steady steam extraction pressure control operation;

wherein the initial low-pressure casing limit pressure is a reference pressure obtained based on an initial pressure correlation line which is different from the pressure correlation line for obtaining the low-pressure casing limit pressure for switching to the steam extraction pressure control operation.

* * * * *